US007623125B2

(12) United States Patent
Harada

(10) Patent No.: US 7,623,125 B2
(45) Date of Patent: Nov. 24, 2009

(54) DISPLAY DRIVE DEVICE AND DRIVE CONTROLLING METHOD

(75) Inventor: Takahiro Harada, Hino (JP)

(73) Assignee: Casio Computer Co., Ltd., Tokyo (JP)

( * ) Notice: Subject to any disclaimer, the term of this patent is extended or adjusted under 35 U.S.C. 154(b) by 505 days.

(21) Appl. No.: 11/128,138

(22) Filed: May 11, 2005

(65) Prior Publication Data

US 2005/0231497 A1 Oct. 20, 2005

(51) Int. Cl.
*G09G 5/00* (2006.01)
*G09G 3/36* (2006.01)

(52) U.S. Cl. ..... 345/211; 245/89; 245/98; 245/690

(58) Field of Classification Search ..... 345/204, 345/690, 208–213, 96, 98–100
See application file for complete search history.

(56) References Cited

U.S. PATENT DOCUMENTS

| | | | | |
|---|---|---|---|---|
| 5,847,688 | A | 12/1998 | Shiba et al. | |
| 6,225,992 | B1 * | 5/2001 | Hsu et al. | 345/211 |
| 6,674,420 | B2 * | 1/2004 | Matsueda et al. | 345/87 |
| 6,762,737 | B2 * | 7/2004 | Kajihara et al. | 345/89 |
| 6,781,605 | B2 | 8/2004 | Kudo et al. | |
| 6,831,620 | B1 * | 12/2004 | Nishikubo et al. | 345/87 |
| 7,126,596 | B1 * | 10/2006 | Hogan | 345/211 |
| 2002/0186231 | A1 | 12/2002 | Kurokawa et al. | |

FOREIGN PATENT DOCUMENTS

| | | | |
|---|---|---|---|
| JP | 10-301538 | A | 11/1998 |
| JP | 2001-16602 | A | 1/2001 |
| JP | 2001-100711 | A | 4/2001 |
| JP | 2001-255853 | A | 9/2001 |
| JP | 2002-366115 | A | 12/2002 |

OTHER PUBLICATIONS

Adachi, M. et al. "Parasitic Capacitance Compensation in TFT-LCDS for HDTV Projection" SID International Symposium Digest of Papers, Boston, May 17-22, 1992, Playa Del Rey, SID, US, vol. 23, May 17, 1992, pp. 785-788, XP000479119, ISSN: 0097-966X.

(Continued)

*Primary Examiner*—Henry N Tran
(74) *Attorney, Agent, or Firm*—Frishauf, Holtz, Goodman & Chick, P.C.

(57) ABSTRACT

A display drive device applied to a display device which drives a display panel (110) comprising a plurality of display pixels (Px) which comprises a gradation voltage setting circuit (40*a*, 40*c*) which sets a plurality of gradation voltages and voltage ranges according to each luminosity gradation of the display data, which reverses the gradation voltages for each luminosity gradation of the display data in a predetermined period while providing a change characteristic of the center voltage in reversal of the gradation voltages for each luminosity gradation corresponding to the change inclination of the field through voltage produced when the display signal voltage of each luminosity gradation is applied, and which maintains this change characteristic constant for changing the voltage range value; and a gradation conversion circuit (30*a*, 30*d*) which produces display signal voltages based on gradation voltages corresponding to the luminosity gradations of the display data.

33 Claims, 15 Drawing Sheets

OTHER PUBLICATIONS

Hori, Hiroo, "Key Issues Regarding High-information-content TFT-LCDS for Data Graphics" Proceedings of the SID, Society for Information display. Playa Del Rey, Ca, US, vol. 32, No. 4, 1991, pp. 331-337, XP 00281855.

Japanese Office Action dated Nov. 18, 2009 (2 pages), and English translation thereof (3 pages), issued in counterpart Japanese Application Serial No. 2002-376241.

* cited by examiner

DISPLAY DRIVE DEVICE AND DRIVE CONTROLLING METHOD

TECHNICAL FIELD

This invention relates to a display drive device and associated drive controlling method applied to a display device of a digital system which displays desired image information on a display panel based on display data composed of digital signals, and more particularly regarding a display drive device and associated drive controlling method which performs drive control of a liquid crystal display panel that employs an active-matrix type drive system.

BACKGROUND ART

In recent years, the spread of image pick-up devices represented by digital video cameras, digital still cameras and the like, as well as cellular/mobile phones and Personal Digital Assistants (PDA's) as display devices for displaying images, text, and the like has been remarkable. Liquid Crystal Displays (LCD's) which are thin-shaped, lightweight with low-power consumption are commonly carried everywhere. Also, amid the rapid replacement of older conventional Cathode Ray Tube (CRT) monitors or displays of computer terminals, televisions and the like with spacesaving devices requiring less power than in the past and due to their excellent image display quality, LCD's are increasingly being manufactured for a multitude of useful purposes.

FIG. 12 is an outline block diagram showing an example of the configuration of the section concerning the output of the display signal voltage of the data driver as applied to a liquid crystal display in a conventional technology.

FIG. 13 is a characteristic drawing showing an example of the relationship of the output level to the input data of a data driver in conventional technology.

In a data driver of prior art, as shown in FIG. 12, for example, is constituted with the changeover switches SPA, SPB, a division resistance Rp, a digital-to-analog converter (D/A Converter: DAC) 10 and an output amplifier AMP 20. The changeover switch SPA is configured with the reference voltage VRH by the high potential side connected to contact Npa and the reference voltage VRL by the low potential side connected to Npb. The changeover switch SPB is configured with the reference voltage VRL by the low potential side connected to contact Npc and the reference voltage VRH by the high potential side connected to contact Npd. The reference voltage (either the high potential side reference voltage VRH or the low potential side reference voltage VRL) are supplied on one end side and on the other end side while selected by the changeover switches SPA and SPB. The division resistance Rp performs a plurality of voltage divisions of the potential difference between the reference voltages supplied to both ends. The D/A Converter DAC 10 to which a plurality of gradation voltages produced by the reference voltage and the division resistance Rp selected by the changeover switches SPA and SPB is supplied, the display data which is composed of digital signals is inputted, and the gradation voltages according to the luminosity gradation of the display data are selected and converted into analog voltage. The output amplifier AMP 20 supplies each of the data lines DL by converting the analog voltage into the display signal voltage Vsig. Here, the changeover switches SPA and SPB switch and control each contact based on a polarity changeover signal POL, which controls the signal polarity of the display signal voltage Vsig, and reverse control of the signal polarity of the display signal voltage Vsig is suitably performed.

In such a configuration, when the polarity changeover signal POL is a high level ("H") as shown in FIG. 13, the changeover switch SPA switches and controls the contact Npa side, and the changeover switch SPB switches and controls the contact Npa side as luminosity gradations of the display data. When the digitized data 00h (the lowest gradation: corresponds to a black display) is inputted, the reference voltage VRH by the high potential side is outputted as the lowest gradation voltage of the display signal voltage Vsig. When the digitized data 3Fh (the highest gradation: corresponds to a white display) is inputted, the reference voltage VRL by the low potential side is outputted as the highest gradation voltage of the display signal Vsig. Also, when the display data of the middle gradations is inputted, the gradation voltage corresponding to the gradation data of the display data is outputted as the display signal voltage Vsig from a plurality of gradation voltages produced by the division resistance Rp.

Conversely, when the polarity changeover signal is a low level ("L"), the changeover switch SPA switches and controls contact Npb side, and the changeover switch SPB switches and controls the contact Npd side. Accordingly, such as the characteristic curve of POL="L" as shown in FIG. 13, when digitized data 00h (the lowest gradation) is inputted as the luminosity gradation of the display data, the reference voltage VRL by the low potential side is outputted as the lowest gradation of the gradation voltage of the display signal voltage Vsig. When the digitized data 3Fh (the highest gradation) is inputted, the reference voltage VRH by the high potential side is outputted as the highest gradation voltage of the display signal voltage Vsig.

Subsequently, the write-in operation of the display signal voltage to the display pixels of an active-matrix type liquid crystal display panel will be briefly explained.

FIG. 14A is an equivalent circuit drawing showing the configuration of the display pixels in an active-matrix type liquid crystal display panel.

FIG. 14B is drawing showing the drive voltage waveform in the case of writing display signal voltage to the display pixel clusters of a predetermined line of the liquid crystal display panel.

The display pixels Px in an active-matrix type liquid crystal display panel, as shown in FIG. 14A, is comprised with a configuration which has a pixel transistor (Thin-Film Transistor) TFT, a liquid crystal capacity Clc and a storage capacitance Ccs. The Thin-Film Transistor TFT by which the source-drain (current path) are connected between the pixel electrode and the data line DL to constitute the liquid crystal capacity Clc, the gate (control terminal) is connected to the scanning line SL, and the single electrode (counter electrode) is arranged countered to the pixel electrode and this pixel electrode. The liquid crystal capacity Clc consists of liquid crystal molecules filled between the counter electrode and the pixel electrode. The storage capacitance Ccs which maintains the signal voltage applied to the liquid crystal capacity Clc (for example, a common signal voltage Vcom) is constituted in parallel with this liquid crystal capacity Clc and connected on the other end side to the predetermined voltage Vcs.

The driver voltage waveform shown in FIG. 14B illustrates a case application of a field reversal drive method which drives the display signal voltage of positive and negative polarity so that it is written to each of the display pixels Px at 30 Hertz (Hz). Therefore, one screen is rewritten every one 60 Hz field period and controlled so that the signal polarity of the display signal voltage is reversed in every one field period. Specifically, the display signal voltage Vsig corresponding to the display data is applied to the pixel transistor TFT drain electrode via the data lines DL in every one field period. Here, the display signal voltage Vsig is set so that the signal polarity alternately reverses to the predetermined center level (display signal center voltage) Vsigc for every one field period. As in FIG. 14B, the display signal voltage Vsig of positive polarity is applied in the n-th field and the display signal voltage Vsig of negative polarity is applied to the n-th +1 field.

Conversely, only during the predetermined write interval (write-in period) Tw of the applied period of the above-mentioned display signal voltage Vsig, the scanning signal Vg is applied to the gate electrode of the pixel transistor TFT via each of the scanning lines SL, and the pixel transistor TFT performs an "ON" operation. Accordingly, the display signal voltage Vsig currently applied to the drain electrode is applied to the pixel electrode connected to the source electrode side. The display signal voltage Vsig is maintained as the pixel electrode voltage Vp until the write-in interval Tw in the next field by the storage capacity Ccs, while the liquid crystal molecules filled between the common electrodes are controlled in a predetermined orientation state. Moreover, the common signal voltage Vcom alternately reverses polarity to the predetermined center level Vcomc in every one field period.

Incidentally, in the liquid crystal display which employs the active-matrix type drive system mentioned above, as shown in FIG. 14B, in the case where the pixel transistor TFT switches from an "ON" state to an "OFF" state according to the applied state of the scanning signal Vg, it is recognized that the so-called "field through phenomenon" originating in the charge accumulated in the liquid crystal capacity Clc, the storage capacitance Ccs and the parasitic capacitance Cgs between the gate-source is redistributed, and that changes to the electrode voltage Vp will occur. Here, generally the fluctuation (field through voltage) ΔV of the pixel electrode voltage Vp by the field through phenomenon is expressed with the following formula (1):

$$\Delta V = Cgs \times Vg / (Cgs + Clc + Cs) \quad (1)$$

Because such field through voltage ΔV generates the electrode voltage Vp in the direction that habitually makes it decrease at the time the scanning signal Vg drops as shown in FIG. 14B, it will change to the negative voltage side of the display signal voltage Vsig positive-negative signal polarity, and the pixel electrode voltage Vp becomes asymmetrical to the center level Vsigc of the display signal voltage Vsig. Therefore, the direct current voltage component on the voltage applied to the liquid crystal capacity Clc resulting from the difference (offset potential) of the positive-negative voltage of the pixel electrode voltage Vp to the center level Vsigc of the display signal voltage Vsig occurs. This represents the origin which causes characteristic deterioration of the display panel accompanying the generation of flicker or accompanying the sticking of the liquid crystal molecules.

Then, in order to control such fault in the past, as shown in FIG. 14B, generally the method of controlling or canceling the imbalance of the pixel electrode voltage Vp positive-negative polarity to the common signal voltage Vcom employed is by compensating (ΔV correction) only the above-mentioned offset potential to the center level Vsigc of the display signal voltage Vsig of the center voltage (common signal center voltage) Vcomc applied to the common electrode.

Here, the relationship between the applied voltage to the liquid crystal and the field through voltage ΔV will be explained.

FIGS. 15A, 15B and 15C are characteristic drawings showing the relationship of the applied voltage to the liquid crystal with the liquid crystal dielectric constant, the liquid crystal capacity and the field through voltage, respectively.

The liquid crystal capacity Clc has the relationships of the following formula (2) to the liquid crystal dielectric constant e (epsilon or "e"), the area S of the pixel electrode and the cell gap d. As shown in FIG. 15A, the dielectric constant e has the characteristic of changing to applied voltage V. As shown in FIG. 15B, the liquid crystal capacity Clc has the change inclination equivalent to the liquid crystal dielectric constant e to the applied voltage V.

$$Clc = e \times S / d \quad (2)$$

Here, since as the field through voltage ΔV has the relationship depending on the change of the liquid crystal capacity Clc as shown in the above-mentioned formula (1), the field through voltage ΔV has the characteristic of complexly changing to the applied voltage V (namely, display signal voltage Vsig) as shown in FIG. 15C. (Hereinafter, description of the change characteristic to applied voltage V of the field through voltage ΔV will be referred to as "ΔΔV characteristic" for convenience.)

However, in the past as shown in FIG. 13, the center level (display signal center voltage) Vsigc in reverse signal polarity of the display signal voltage Vsig (gradation voltage) is set so that it becomes a constant value to the input data (luminosity gradation). Therefore, as shown in FIG. 14B, by the method compensated only by a constant offset potential which previously set the common signal voltage Vcom, it migrates the overall gradation range of the display signal voltage Vsig. The fluctuation of the pixel electrode voltage Vp by the field through voltage ΔV can not be canceled favorably, and the generation of flicker under the effect of the field through voltage ΔV, sticking of the liquid crystal molecules and the like cannot be sufficiently controlled.

DISCLOSURE OF THE INVENTION

The present invention has been made in view of the circumstances mentioned above. Accordingly, in the drive device applied to a display device and its associated drive controlling method which performs reversal drive of an active-matrix type liquid crystal display panel, this invention controls the fluctuation effect according to the voltage level of the display signal voltage of the field through voltage. The present invention has an advantage to achieve improvement in the display quality and the longevity life of the display panel.

In the first display drive applied to the data driver of a display device in this invention for acquiring the above-mentioned advantage, the display drive device which drives a display panel comprises a plurality of display pixels based on display data composed of digital signals comprising at least a gradation voltage setting circuit comprising a means which sets a plurality of gradation voltages corresponding to each luminosity gradation of the display data based on the highest reference voltage and lowest reference voltage and which sets the voltage range of these gradation voltages; a means which reverses each gradation voltage value in a predetermined period; a means which changes the voltage range value according to reversal of the gradation voltages; a means which provides a predetermined change characteristic value of the center voltage in reversal of the gradation voltages for each luminosity gradation; a means which maintains the change characteristic constant for changing the voltage range value change; a gradation conversion circuit which produces a display signal based on gradation voltages corresponding to the luminosity gradations of the display data; a display signal voltage output circuit which applies the display signal voltage to the display pixels; and the change characteristics in which linear change inclination or nonlinear change inclination according to the change inclination of the field through voltage produced when the display signal voltage of each luminosity gradation is applied to the display pixels.

According to the present invention, the gradation voltage setting circuit comprises, for example, a means which sets the highest gradation voltage and lowest gradation voltage which regulate the voltage range of the display signal voltage based on the highest reference voltage and lowest reference voltage; a voltage divider circuit which consists of a plurality of resistance elements connected in series with the highest gradation voltage and the lowest gradation voltage is applied at both ends of these plurality of resistance elements; which performs voltage division of the potential difference between the highest gradation voltage and the lowest gradation voltage in a plurality of stages, and which produces a plurality of gradation voltages; a means which sets the first highest gradation voltage and lowest gradation voltage which regulate the voltage range in one side of the reverse gradation voltages as the highest gradation voltage and lowest gradation voltage; a means which sets the second highest gradation voltage and lowest gradation voltage which regulate the voltage range in the other side of the reverse gradation voltages; a means which sets a value changed to the opposite direction to each other by a correction voltage which has a voltage value corresponding to the voltage difference of the field through voltage produced by the display signal voltage corresponding to the highest gradation voltage and the lowest gradation voltage is applied to the display pixels corresponding to the first highest gradation voltage and lowest gradation voltage or the second highest gradation voltage and lowest gradation voltage, for example, according to reversal of the gradation voltages, alternately switches the highest gradation voltage and the lowest gradation voltage which is applied to both ends of the dividing circuit to the first highest gradation voltage and lowest gradation voltage with the second highest gradation voltage and lowest gradation voltage; a gradation voltage switching circuit comprises a switching element which alternately selects either the first highest reference voltage and first the lowest reference voltage or the second highest reference voltage and second lowest reference voltage.

Additionally, according to the present invention, the gradation conversion circuit comprises a gradation voltage selection circuit which selects the gradation voltage corresponding to the luminosity gradations of the display data from a plurality of gradation voltages produced by the voltage divider circuit and makes these selected gradation voltages to the display signal voltage.

According to the present invention, the voltage divider circuit can also be configured to comprise a voltage divider circuit switching circuit which selects a first voltage divider circuit or a second voltage divider circuit according to reversal of the gradation voltages. The first voltage divider circuit where the first highest reference voltage and lowest reference voltage is applied at both ends, and the second voltage divider circuit where the second highest reference voltage and lowest reference voltage is applied at both ends, and which have different voltage divider characteristics to each other.

In the second display drive applied to the data driver of a display device in this invention for acquiring the above-mentioned advantage, the display drive device which drives a display panel comprises a plurality of display pixels based on display data composed of digital signals comprising at least a storage circuit which stores information showing the relationship of the gradation voltages for each luminosity gradation of the display data; a gradation voltage setting circuit which sets a plurality of gradation voltages corresponding to each luminosity gradation of the display data based on the highest reference voltage and the lowest reference voltage; a gradation conversion circuit which produces a display signal voltage based on the gradation voltages corresponding to the luminosity gradations of the display data from a plurality of gradation voltages set by the gradation voltage setting circuit based on the relationship of the gradation voltages for each luminosity gradation stored in the storage circuit; and a display signal voltage output circuit which applies the display signal voltage to the display pixels.

According to the present invention, the gradation conversion circuit comprises a means which reverses the signal polarity of the display signal voltage based on the gradation voltages in a predetermined period on the basis of the relationship of the gradation voltages for each luminosity gradation stored in the storage circuit and provides a predetermined change characteristic value of the center voltage in reverse signal polarity of the display signal voltage for each luminosity gradation; a means which maintains constant the change characteristic for changing the highest reference voltage and lowest reference voltage; a means which sets the first highest gradation voltage and lowest gradation voltage which regulate the voltage range of the display signal in one side of the signal polarity; a means which sets the second highest gradation voltage and lowest gradation voltage which regulate the voltage range of the display signal in the other side of the signal polarity; a means which sets a value changed to the opposite direction to each other by a correction voltage which has a voltage value corresponding to a voltage difference of the field through voltage produced by the display signal voltage corresponding to the highest gradation voltage and the lowest gradation voltage is applied to the display pixels corresponding to the first highest gradation voltage and lowest gradation voltage or the second highest gradation voltage and lowest gradation voltage; and the change characteristics in which linear change inclination or nonlinear change inclination according to the change inclination of the field through voltage produced when the display signal voltage of each luminosity gradation is applied to the display pixels.

Furthermore, according to the present invention, the gradation voltage setting circuit comprises a voltage divider circuit which applies the highest gradation voltage and lowest gradation voltage at both ends, performs voltage division of the potential difference between the highest gradation voltage and the lowest gradation voltage in a plurality of stages, and produces a plurality of gradation voltages; and the gradation conversion circuit comprises a gradation voltage selection circuit which selects the gradation voltage corresponding to the luminosity gradations of the display data from a plurality of gradation voltages produced by the voltage divider circuit and makes these selected gradation voltages to the display signal voltage.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BEST MODE FOR CARRYING OUT THE INVENTION

The present invention is to provide a display device with a display drive device applied and the drive controlling method for the display drive device which will hereinafter be described in detail with reference to the preferred embodiments shown in the accompanying drawings.

<<Display Device>>

Initially, the display device which performs drive control of the active-matrix type liquid crystal display panel and can apply the display drive device concerning this invention will be explained with reference to the drawings.

Figure 1:
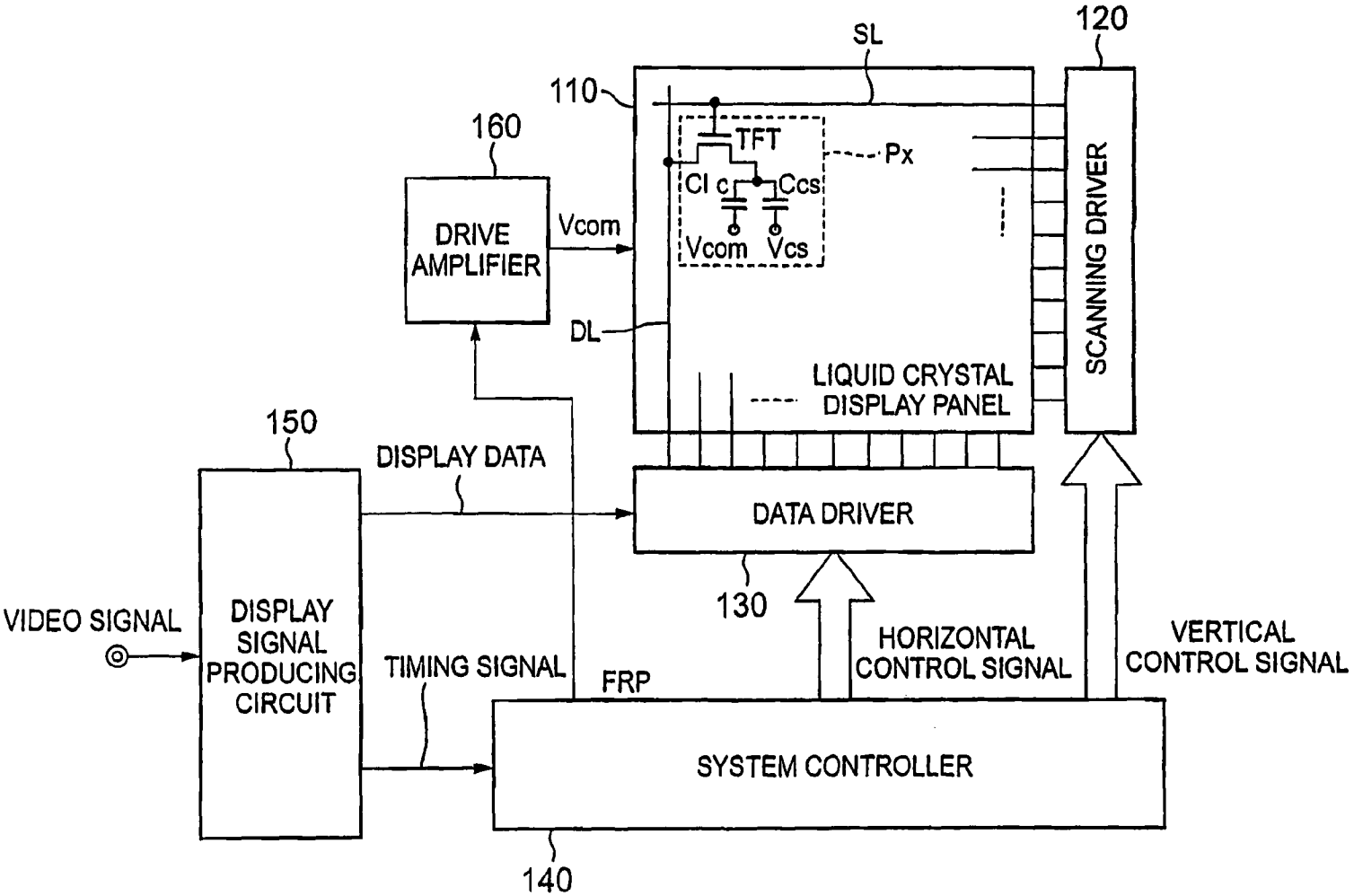
FIG. 1 is a block diagram showing the outline configuration of the display device which performs drive control of the active-matrix type liquid crystal display panel and can apply the display drive device related to this invention.

FIG. 1 is a block diagram showing the outline configuration of the display device which performs drive control of the active-matrix type liquid crystal display panel and can apply the display drive device related to this invention.

As shown in FIG. 1, the display device comprises a liquid crystal display panel (display panel) 110 in which the display pixels Px are ordered in a two-dimensional array; a scanning driver 120 performs sequential scanning of each line of the display pixel Px clusters of the display panel 110 and sets a selective state; a data driver (display drive device) 130 collectively outputs display signal voltage based on the video signals to the display pixel Px clusters of each line set in a selective state; a system controller 140 produces and outputs control signals (vertical control signal, horizontal controls signal, and the like) for controlling the timing operation in the scanning driver 120 and the data driver 130; a display signal producing circuit 150 while extracting various timing signals from the video signals outputs to the system controller 140 produces the display data composed of digital signals and outputs to the data driver 130; and a common signal drive amplifier (drive amplifier) 160 applies a common signal voltage Vcom that has a predetermined voltage polarity to the common electrode provided in common to each display pixel of the liquid crystal display panel 110 based on a polarity reversal signal FRP produced by the system controller 140. Since the configuration of the display pixels Px in the liquid crystal display panel 110 is conventionally the same as in the past, that description is omitted.

In a liquid crystal display which has such a configuration, the video signals are inputted externally. While various timing signals are separated by the display signal producing circuit 150 supplied to the system controller 140, the display data composed of digital signals is separated and supplied to the data driver 130. Also, the system controller 140 produces the polarity reversal signal FRP and operates so that the common signal drive amplifier 160 is supplied, while at the same time produces the vertical control signal and the horizontal control signal and supplies them respectively to the scanning driver 120 and data driver 130 based on various timing signals.

<<The First Embodiment of the Display Drive Device>>

Next, the first embodiment of the data driver (display drive device) concerning this invention will be explained with reference to the drawings.

Figure 2:
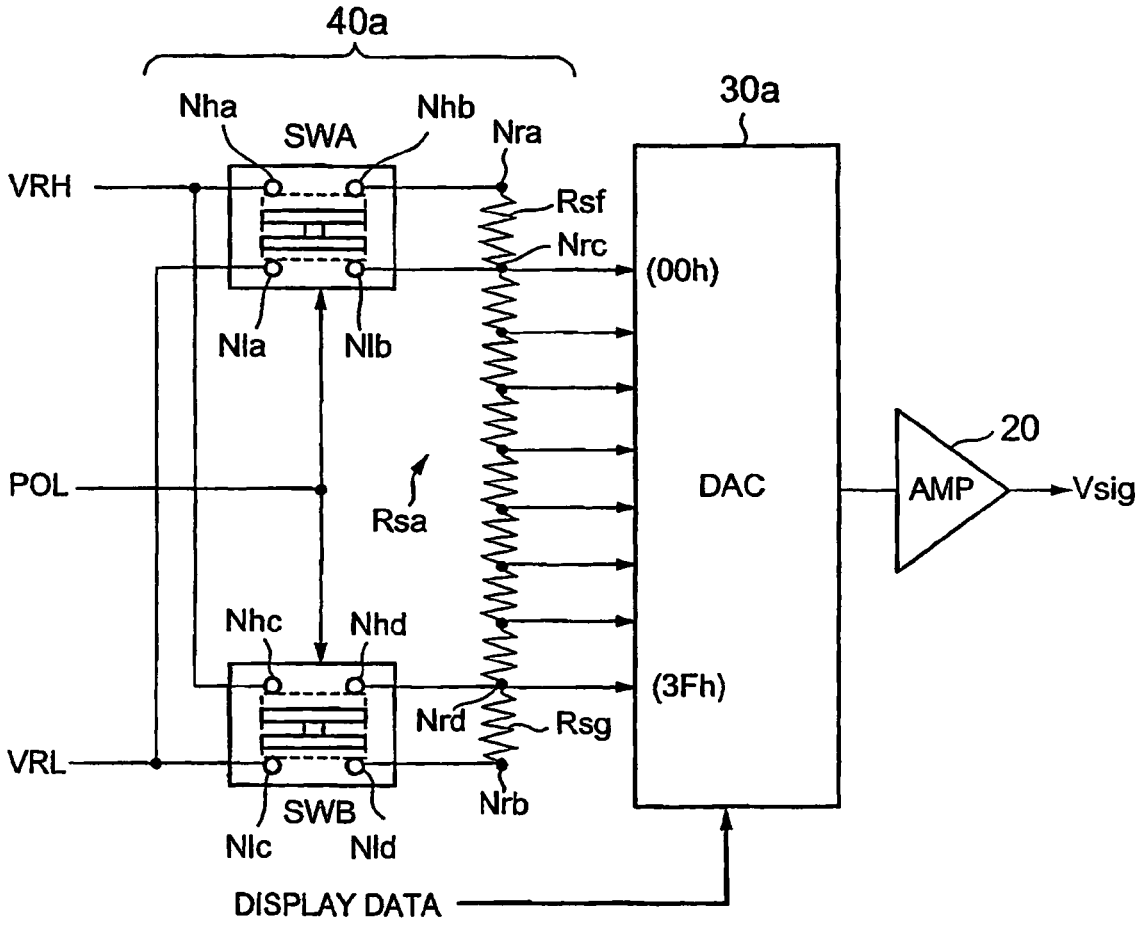
FIG. 2 is an outline block diagram showing the first embodiment section concerning the output of the display signal voltage of the data driver related this invention.

FIG. 2 is an outline block diagram showing the first embodiment section concerning the output of the display signal voltage of the data driver related this invention.

Figure 3A:
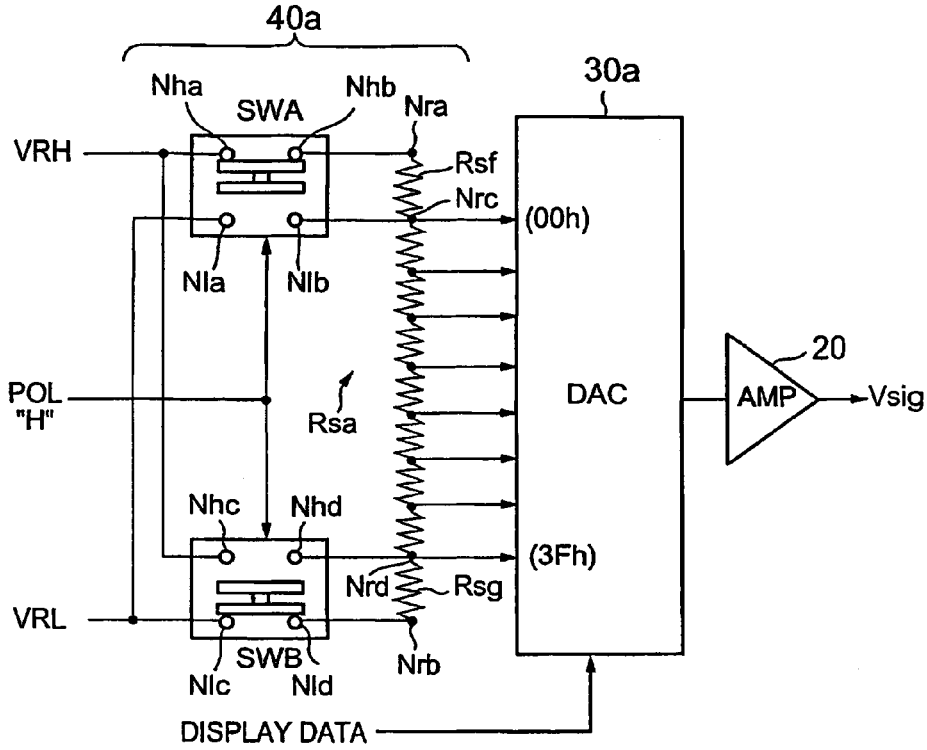
FIGS. 3A and 3B are conceptual diagrams showing an operating state of the data driver concerning the first embodiment
Figure 3B:
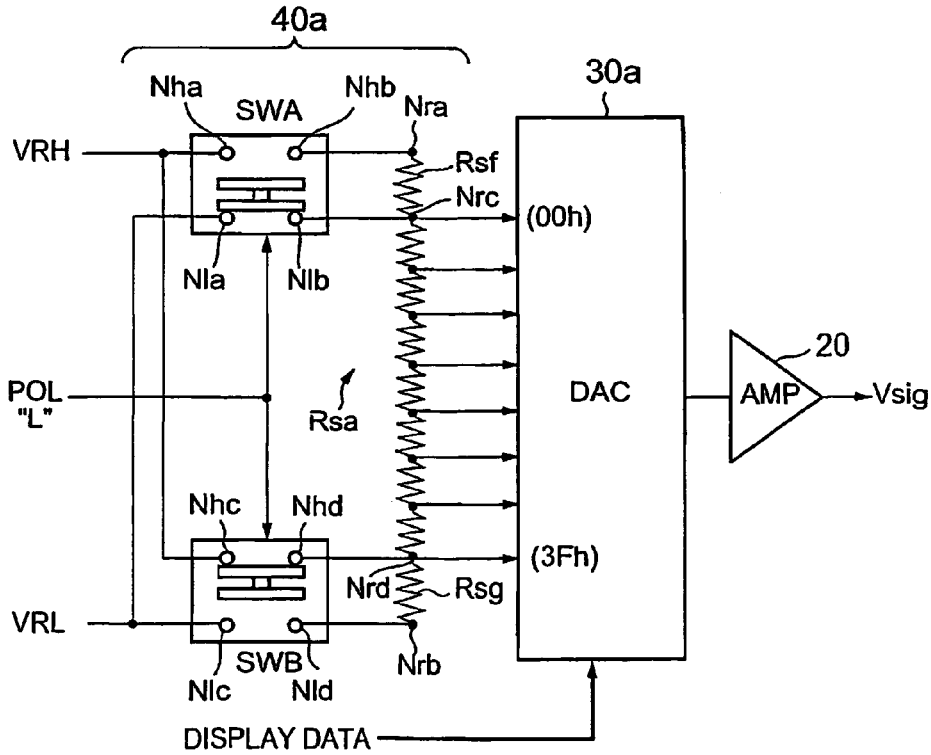

FIGS. 3A and 3B are conceptual diagrams showing an operating state of the data driver concerning this embodiment.

Figure 4:
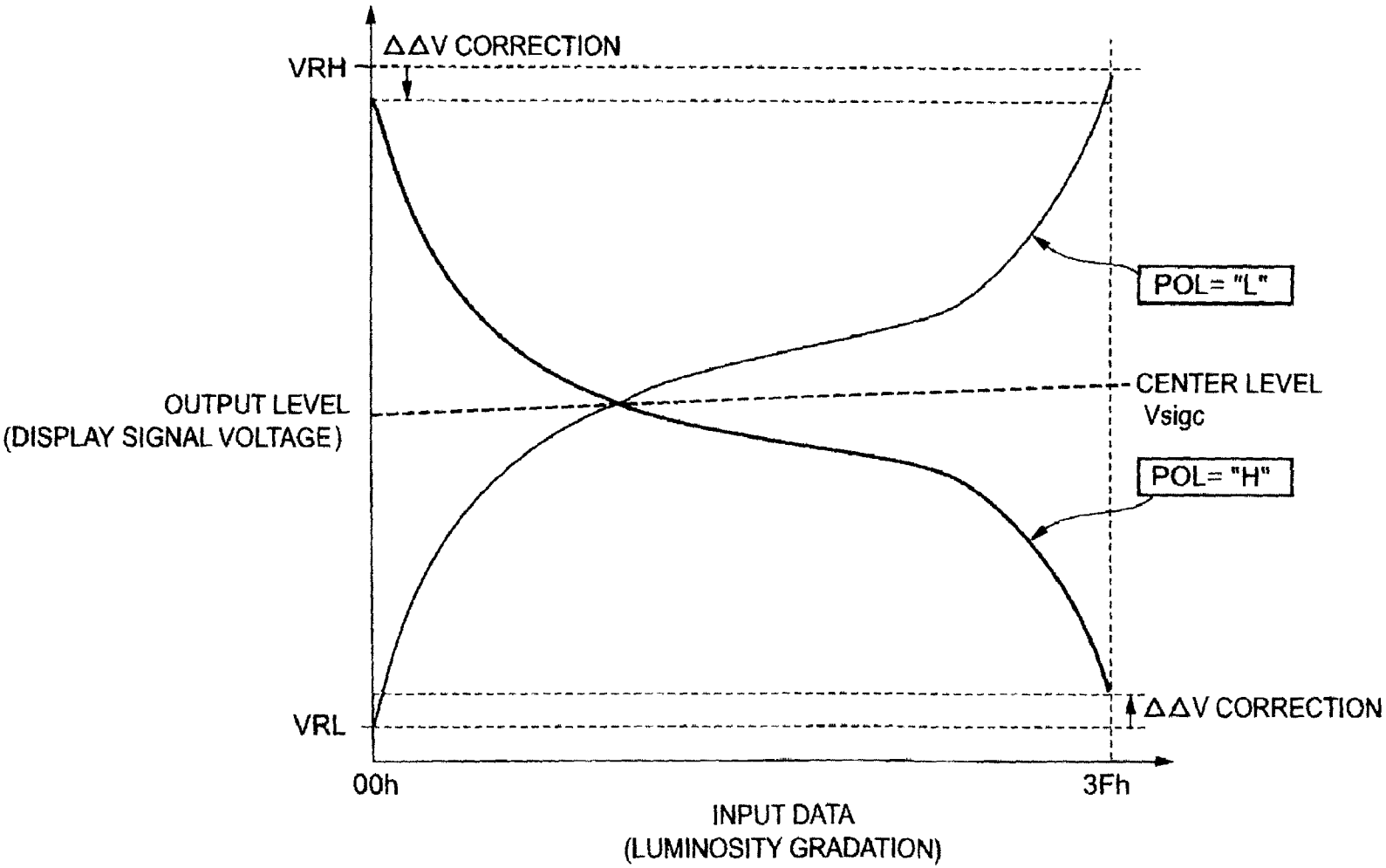
FIG. 4 is a characteristic drawing showing an example of the relationship of the output level to the input data of the data driver concerning the first embodiment.

FIG. 4 is a characteristic drawing showing an example of the relationship of the output level (display signal voltage) to the input data (luminosity gradations) of the data driver concerning the first embodiment.

Figure 13:
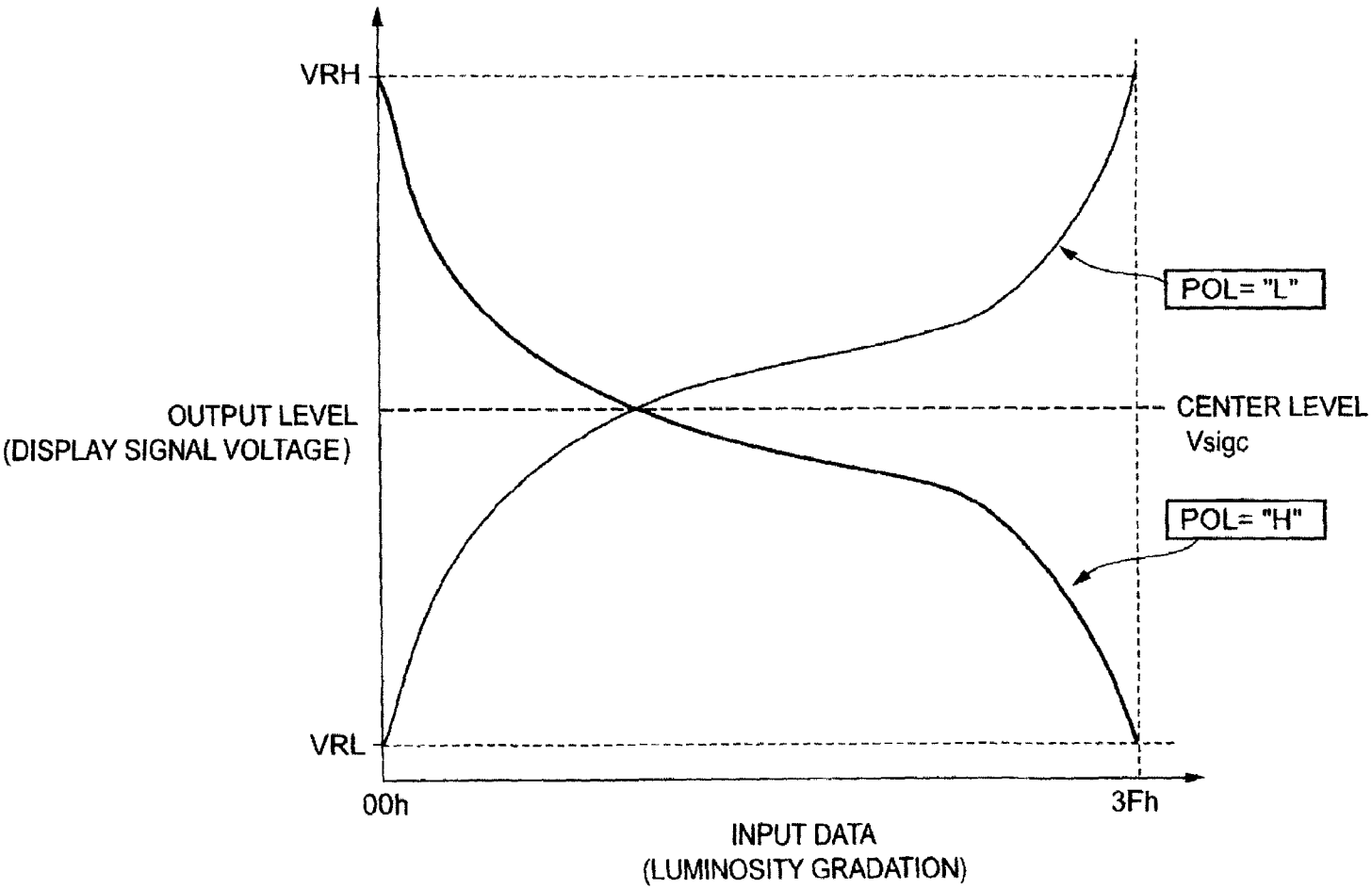
FIG. 13 PRIOR ART
FIG. 13 is a characteristic drawing showing an example of the relationship of the output level to the input data of a data driver in a conventional technology.

In addition, with regard to any configuration equivalent (FIG. 13) of the conventional technology mentioned above, the same or equivalent nomenclature is appended to simplify the explanation. Also, explanation will refer accordingly to the configuration (FIG. 1) of the display device mentioned above.

As shown in FIG. 2, the data driver (display drive device) concerning this embodiment comprises, for example, a gradation voltage setting circuit 40*a*, a D/A (Digital-Analog) Converter (gradation conversion circuit) DAC 30*a*, and an output amplifier (display signal voltage output circuit) AMP 20. The gradation voltage setting circuit 40*a* is designed with the changeover switches SWA, SWB and a division resistance Rsa (voltage divider circuit). In the changeover switch (gradation voltage switching circuit: switching element) SWA, the reference voltage (highest reference voltage) VRH by the high potential side is connected to contact Nha and the reference voltage (lowest reference voltage) VRL by the low potential side is connected to contact Nla. In the changeover switch (gradation voltage switching circuit: switching element) SWB, the reference voltage VRH by the high potential side is connected to contact Nhc and the reference voltage VRL by the low potential side is connected to contact Nlc. The division resistance Rsa consists of a plurality of resistance elements connected in series which performs a plurality of voltage divisions of the potential difference between the voltages supplied to the internal nodes Nrc and Nrd and produces a plurality of gradation voltages. The reference voltage (the high potential side reference voltage VRH output from contact Nhb or the low potential side reference voltage VRL output from contact Nlb) while selected by the changeover switch SWA is supplied to contact Nra or contact Nrc on one end side. The reference voltage (the high potential side reference voltage VRH output from contact Nhd or the low potential side reference voltage VRL output from contact Nld) while selected by the changeover switch SWB is supplied to internal node Nrd or terminal end contact Nrb on the other end side. The D/A Converter DAC 30*a* comprises a gradation voltage selection circuit which is supplied the reference voltages selected by the changeover switches SWA, SWB and a plurality of gradation voltages are produced from the division resistance Rsa, along with the display data composed of digital signals inputted and supplied from the display signal producing circuit 150, and selects the gradation voltages corresponding to the luminosity gradations of the display data and converts into analog voltage. The output amplifier AMP 20 supplies each of the data lines DL by converting the analog voltage into the display signal voltage Vsig.

Here, the changeover switches SWA and SWB are switched and controlled synchronously in combination by the contact Nha and contact Nhb side along with the contact Nlc and contact Nld side, and in combination by the contact Nla and contact Nlb side along with the contact Nhc and contact Nhd side, based on a polarity changeover signal POL supplied from the system controller 140.

Additionally, the contact Nhb is connected to terminal end contact Nra on one side of the division resistance Rsa and contact Nlb is connected to the internal node Nrc on the alike end side of the division resistance Rsa. The contact Nld is connected to terminal end contact Nrb on the other side of the division resistance Rsa and contact Nhd is connected to the internal node Nrd on the alike end side of the division resistance Rsa.

In the gradation voltage setting circuit 40*a* of the data driver which has such a configuration, when the polarity changeover signal POL is set as a high level ("H") as shown in FIG. 3A, as the changeover switch SWA switches and controls the contact Nha-contact Nhb side, the changeover switch SWB switches and controls the contact Nlc-contact Nld side. Accordingly, the reference voltage (highest reference voltage) VRH by the high potential side is applied to the terminal end contact Nra side on one end of the division resistance Rsa. While the reference voltage (lowest reference voltage) VRL by the low potential side is applied to the terminal end contact Nrb side on the other end. The voltage of the internal node Nrc becomes the voltage decreased by the voltage amount (correction voltage: ΔΔV correction amount) equivalent to the resistance Rsf between the terminal end contact Nra from the internal node Nrc of the division resistance Rsa to the reference voltage (highest reference voltage) VRH by the high potential side. The voltage of the internal node Nrd becomes the voltage increased by the voltage amount equivalent to the resistance Rsg between the terminal end contact Nrb from the internal node Nrd of the division resistance Rsa to the reference voltage (lowest reference voltage) VRL by the low potential side. While the voltages of these internal nodes Nrc and Nrd are supplied to the D/A Converter DAC 30*a* as the highest gradation voltage and lowest gradation voltage, a plurality of gradation voltages are produced from the division resistance Rsa between internal nodes Nrc and Nrd are supplied to the D/A Converter DAC 30*a*. Here, the correction voltage by the high potential and low potential sides is set as the same voltage and as the voltage equivalent to the voltage difference produced when the highest gradation voltage and lowest gradation voltage of the field through voltage ΔV in the above-mentioned display pixels Px is applied.

Therefore, the characteristic curve POL="H" as shown in FIG. 4, when the digitized data 00h (corresponds to a black display) which is the lowest gradation, for example, is inputted as the luminosity gradations of the display data composed of digital signals, the voltage (VRH−ΔΔV) which decreased by the correction voltage (ΔΔV correction amount) equivalent to the resistance Rsf outputs as the lowest gradation voltage (second lowest gradation voltage) of the display signal voltage Vsig (gradation voltage) to the reference voltage (highest reference voltage) VRH by the high potential side. When the digitized data 3Fh (corresponds to a white display) which is the highest gradation is inputted, the voltage (VRH+ΔΔV) which increased by the correction voltage (ΔΔV correction amount) equivalent to the resistance Rsg outputs as the highest gradation voltage (second highest gradation voltage) of the display signal voltage Vsig (gradation voltage) to the reference voltage (lowest reference voltage) VRL by the low potential side. In other words, in the data driver concerning this embodiment, ΔΔV correction by the correction voltage of the same voltage is performed in both the high potential side and low potential side. Additionally, when the display data of the middle gradations is inputted, the gradation voltages corresponding to the luminosity gradations of the display data are outputted as the display signal voltage Vsig from a plurality of gradation voltages produced by the division resistance Rsa between the internal node Nrd from the internal node Nrc within the division resistance Rsa.

Conversely, when the polarity changeover signal POL is set as a low level ("L") as shown in FIG. 3B, as the changeover switch SWA switches and controls the contact Nla-contact Nlb side, the changeover switch SWB switches and controls the contact Nhc-contact Nhd side. Thereby, the reference voltage (lowest reference voltage) VRL by the low potential side is applied to the internal node Nrc of the division resistance Rsa. Also, the reference voltage (highest reference voltage) VRH by the high potential side is applied to the internal node Nrd. While the voltages of these internal nodes Nrc and Nrd are supplied to the D/A Converter DAC 30*a* as the highest gradation and lowest gradation voltage, a plurality of gradation voltages are produced from the division resistance Rsa between internal nodes Nrc and Nrd and supplied to the D/A Converter DAC 30*a*.

Consequently, such as the characteristic curve POL="L" as shown in FIG. 4, when the digitized data 00h which is the lowest gradation is inputted as the luminosity gradation of the display data, the reference voltage VRL by the low potential side is outputted as the lowest gradation voltage (first lowest gradation voltage) of the display signal voltage Vsig. When the digitized data 3Fh which is the highest gradation is inputted, the reference voltage VRH by the high potential side is outputted as the highest gradation voltage (first highest gradation voltage) of the display signal voltage Vsig.

As mentioned above, the level of the gradation voltage is reversed according to reversal of the polarity changeover signal POL (POL="H" and POL="L") and reverse control of the signal polarity of the display signal voltage Vsig (gradation voltage) is performed. Also, as shown in FIG. 4, in the reverse gradation voltages corresponding to reversal of the polarity changeover signal POL, the center level (display signal center voltage) Vsigc regulates with an average value of the display signal voltage Vsig (gradation voltage) corresponding to each luminosity gradation of the input data (luminosity gradations), which is set so that it changes to linear the voltage amount according to the correction voltage (ΔΔV correction amount) and controls the fluctuation effect (ΔΔV characteristic) of the field through voltage ΔV.

Next, the effectiveness in the case of applying the data driver concerning this embodiment as compared with the configurations of other data drivers will be explained.

First, the configuration of other data drivers used as objects for comparison will be explained.

Figure 5:
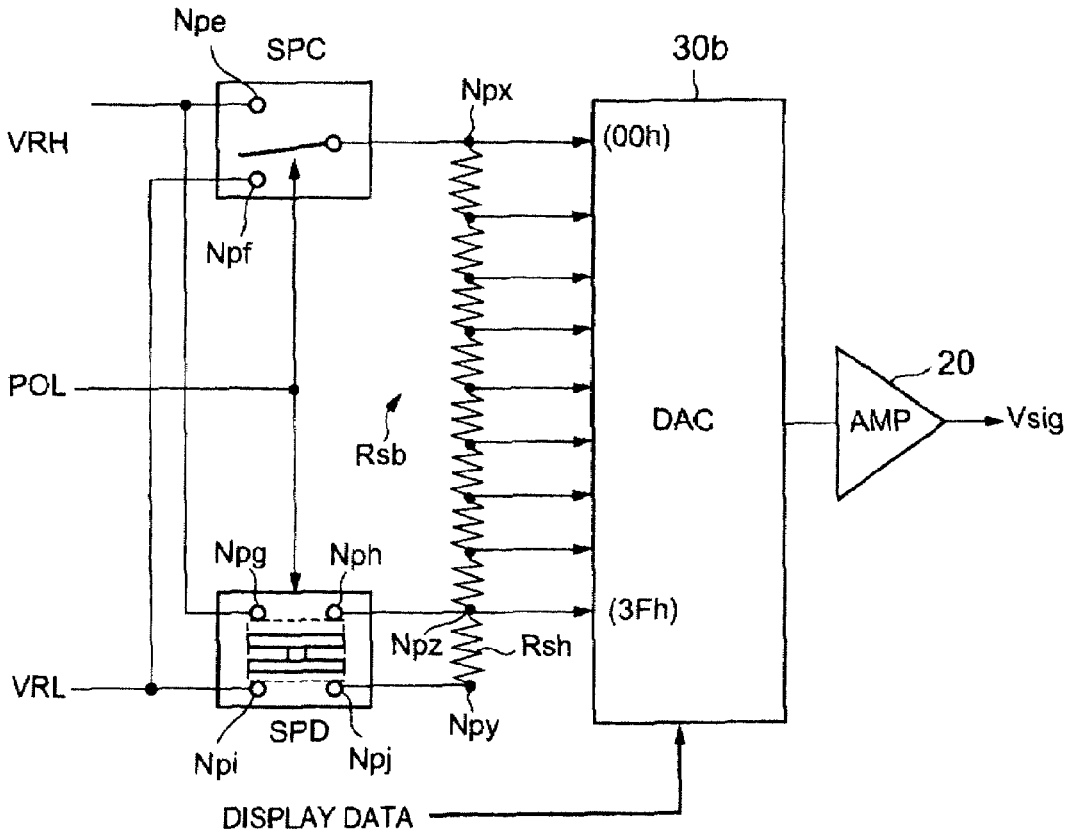
FIG. 5 is an outline block diagram showing an example for comparison of the data driver concerning the first embodiment.

FIG. 5 is an outline block diagram showing an example for comparison of the data driver concerning the first embodiment.

Figure 6A:
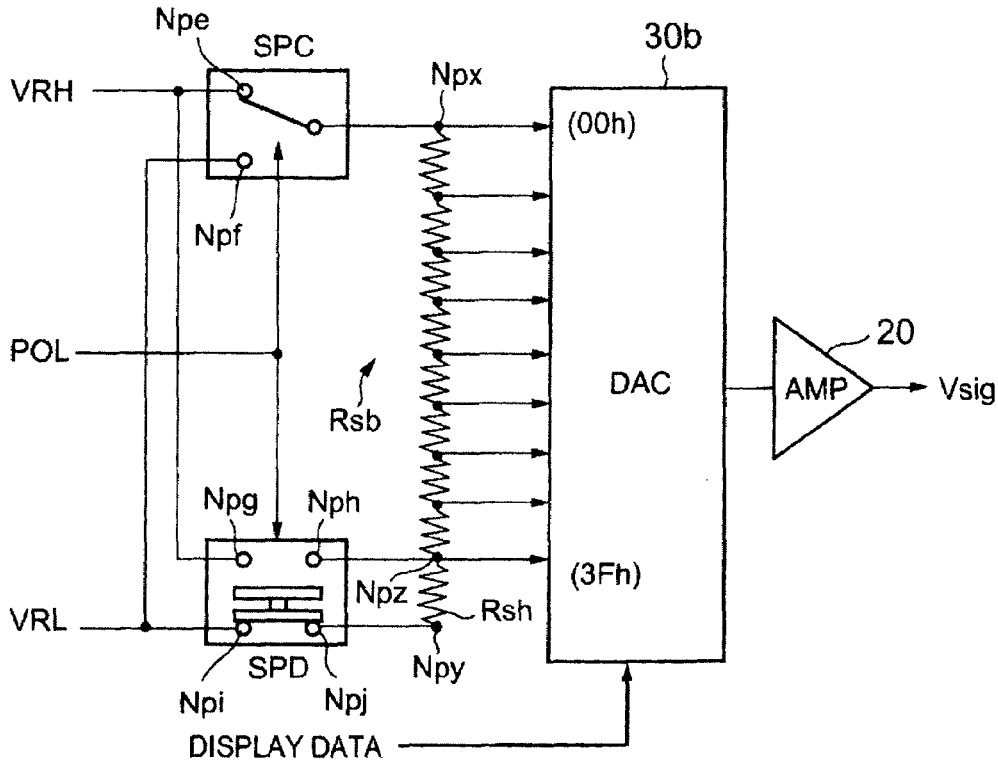
FIGS. 6A and 6B are conceptual diagrams showing an operating state of the data driver used as an object for comparison.
Figure 6B:
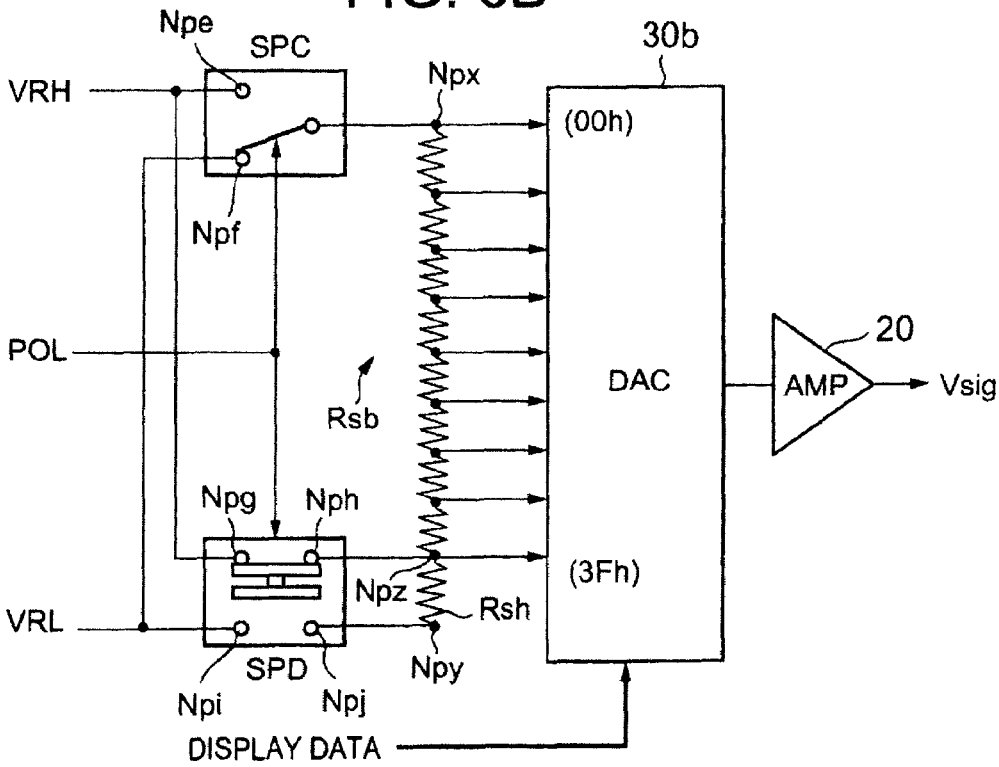

FIGS. 6A and 6B are conceptual diagrams showing an operating state of the data driver used as an object for comparison.

Figure 7:
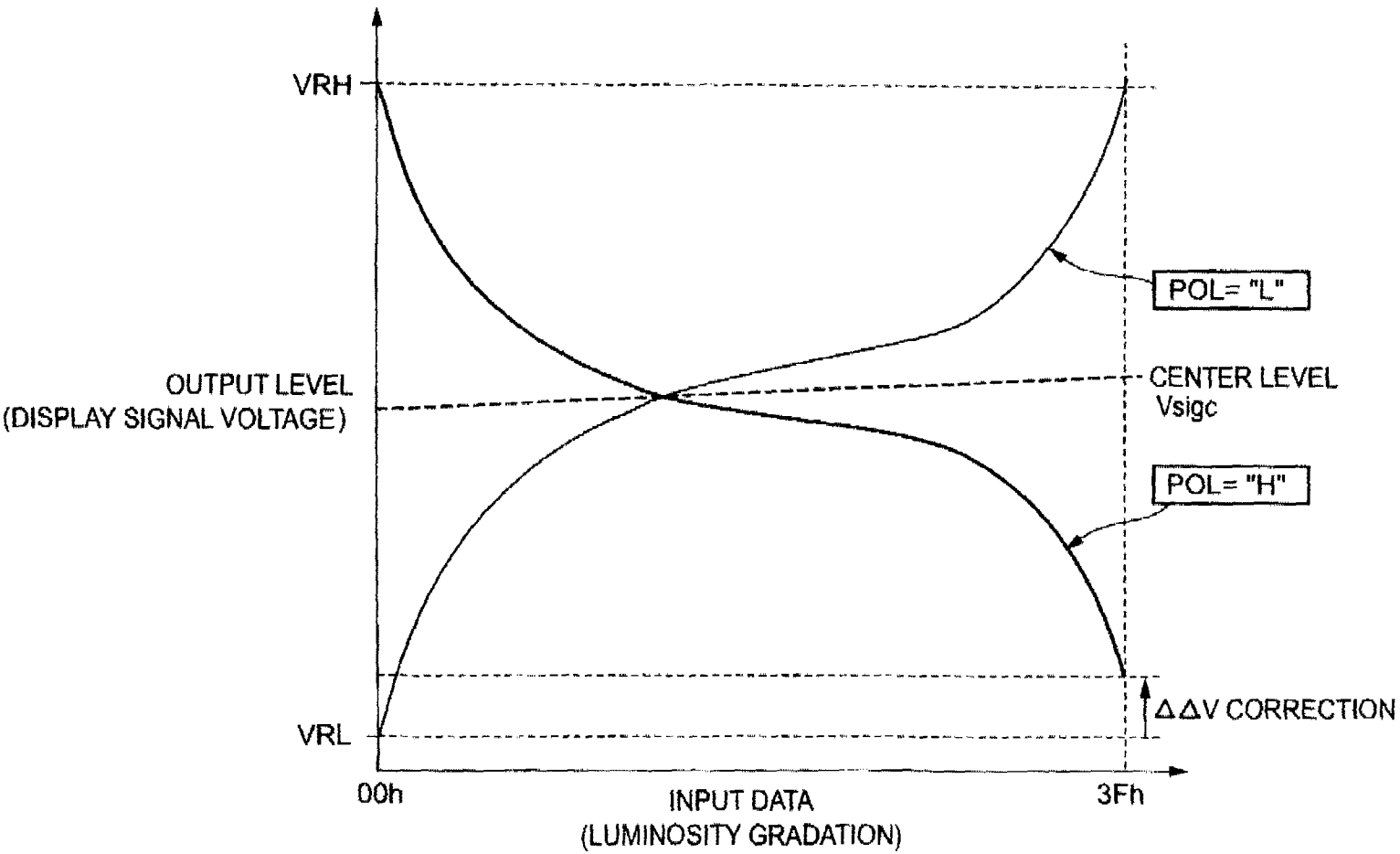
FIG. 7 is a characteristic drawing showing an example of the relationship of the output level to the input data of the data driver used as an object for comparison.

FIG. 7 is a characteristic drawing showing an example of the relationship of the output level to the input data of the data driver used as an object for comparison.

Here, in order to control the fluctuation effect (ΔΔV characteristic) of the field through voltage ΔV as an object for comparison of the data driver related to this embodiment, a configuration which is made to change the center level Vsigc of the display signal voltage Vsig (gradation voltage) outputted from the data driver corresponding to the inputted data (luminosity gradations) is used. This case explains where it controls change only the reference voltage VRL by the low potential side, on one side of the signal polarity of the display signal voltage Vsig (gradation voltage).

Specifically, the data driver used as the object for comparison, for example as shown in FIG. 5, changes the changeover switches SWA, SWB in the configuration (FIG. 2) of the first embodiment mentioned above which has a configuration comprising the changeover switches SPC, SPD. The changeover switch SPC is on the side of the reference voltage VRH by the high potential side, and the changeover switch SPD is on the side of the reference voltage VRL by the low potential side. As for the changeover switch SPC, the reference voltage VRH by the high potential side is connected to contact Npe, and the reference voltage VRL by the low potential side is connected to contact Npf. Additionally, as for the changeover switch SPD, the reference voltage VRH by the high potential side is connected to contact Npg, and the reference voltage VRL by the low potential side is connected to contact Npi. As for the division resistance Rsb, the reference voltage (the low potential side reference voltage VRL applied to contact Npf or the high potential side reference voltage VRH applied to contact Npe) while selected by the changeover switch SPC, is supplied to the terminal end contact Npx on one end side. The reference voltage (the low potential side reference voltage VRL output from contact Nph or the high potential side reference voltage VRH output from contact Npj) while selected by the changeover switch SPD, is supplied to internal node Npz and terminal end contact Npy on the other end side, which performs a plurality of voltage divisions of the potential difference between the voltages and produces a plurality of gradation voltages.

Here, the changeover switches SPC and SPD, for example, are switched and controlled synchronously in combination by the contact Npi and contact Npj side along with the contact Npe side; and in combination by the contact Npg and contact Nph side along with the contact Npf side, based on the polarity changeover signal POL supplied from the system controller 140. Additionally, the selection point (Either the low potential side reference voltage VRL applied to contact Npf or the high potential side reference voltage VRH applied to contact Npe is selectively outputted.) of the changeover switch SPC is connected to the terminal end contact Npx on one side of the division resistance Rsb, and contact Npj is connected to the terminal end contact Npy on the other side of the division resistance Rsb. The contact Nph is connected to the internal node Npz on the alike end side of the division resistance Rsb. Furthermore, since the configuration of the D/A Converter DAC 30*b* and the output amplifier AMP 20 are equivalent to the first embodiment mentioned above, the description is omitted.

In the data driver which has such a configuration, when the polarity changeover signal POL is set as a high level ("H") as shown in FIG. 6A, as the changeover switch SPC switches and controls the contact Npe side, the changeover switch SPD switches and controls the contact Npi-contact Npj side. Accordingly, the reference voltage (highest reference voltage) VRH by the high potential side is applied to the terminal end contact Npx on one end of the division resistance Rsb. While the reference voltage VRL by the low potential side is applied to the terminal end contact Npy on the other end. The voltage of the internal node Npz becomes the voltage increased by the voltage amount equivalent to the resistance Rsh between the terminal end contact Npy from the internal node Npz of the division resistance Rsb to the reference voltage (lowest reference voltage) VRL by the low potential side. The gradation voltages are produced by performing voltage division of the potential difference between the terminal end contact Npx and the internal node Npz and supplied to the D/A Converter DAC 30*b*.

Therefore, such as the characteristic curve POL="H" as shown in FIG. 7, when the digitized data 00h which is the lowest gradation is inputted as the luminosity gradation of the display data composed of digital signals, the reference voltage VRH by the high potential side is outputted as the lowest gradation voltage of the display signal voltage Vsig. When the digitized data 3Fh which is the highest gradation is inputted the voltage (VRL+ΔΔV) increased by the voltage amount equivalent to the resistance Rsh is outputted as the highest gradation voltage of the display signal voltage Vsig to the reference voltage VRL by the low potential side. Also, when the display data of the middle gradations is inputted, the gradation voltages corresponding to the luminosity gradations of the display data are outputted as the display signal voltage Vsig from a plurality of gradation voltages produced by the division resistance Rsb between the internal node Npz from the terminal end contact Npx.

Conversely, when the polarity changeover signal POL is set as a low level ("L") as shown in FIG. 6B, as the changeover switch SPC switches and controls the contact Npf side, the changeover switch SPD switches and controls the contact Npg-contact Nph side. Thereby, the reference voltage (lowest reference voltage) VRL by the low potential side is applied to the terminal end contact Npx on the one end side of the division resistance Rsb. Also, the reference voltage (highest reference voltage) VRH by the high potential side is applied to the internal node Npz, and the voltages of the terminal end contact Npx and the internal node Npz are supplied to the D/A Converter DAC 30*b* as the highest gradation voltage and lowest gradation voltage.

Consequently, such as the characteristic curve POL="L" as shown in FIG. 7, when the digitized data 00h which is the lowest gradation is inputted as the luminosity gradation of the display data, the reference voltage VRL by the low potential side is outputted as the lowest gradation voltage of the display signal voltage Vsig. When the digitized data 3Fh which is the highest gradation is inputted, the reference voltage VRH by the high potential side is outputted as the highest gradation voltage of the display signal voltage Vsig. When the display data of the middle gradations is inputted, the gradation voltages produced by performing voltage division of the potential difference between the terminal end contact Npx and the internal node Npz from the division resistance Rsb are supplied to the D/A Converter DAC 30*b*.

Figure 14A:
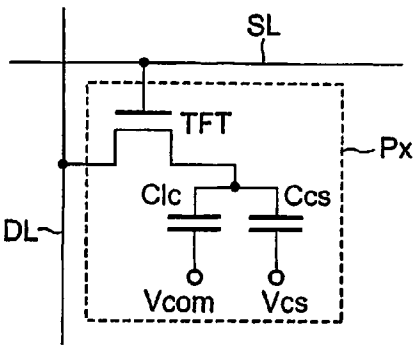
FIG. 14A PRIOR ART
FIG. 14A is an equivalent circuit drawing showing the configuration of the display pixels in an active-matrix type liquid crystal display panel.
Figure 14B:
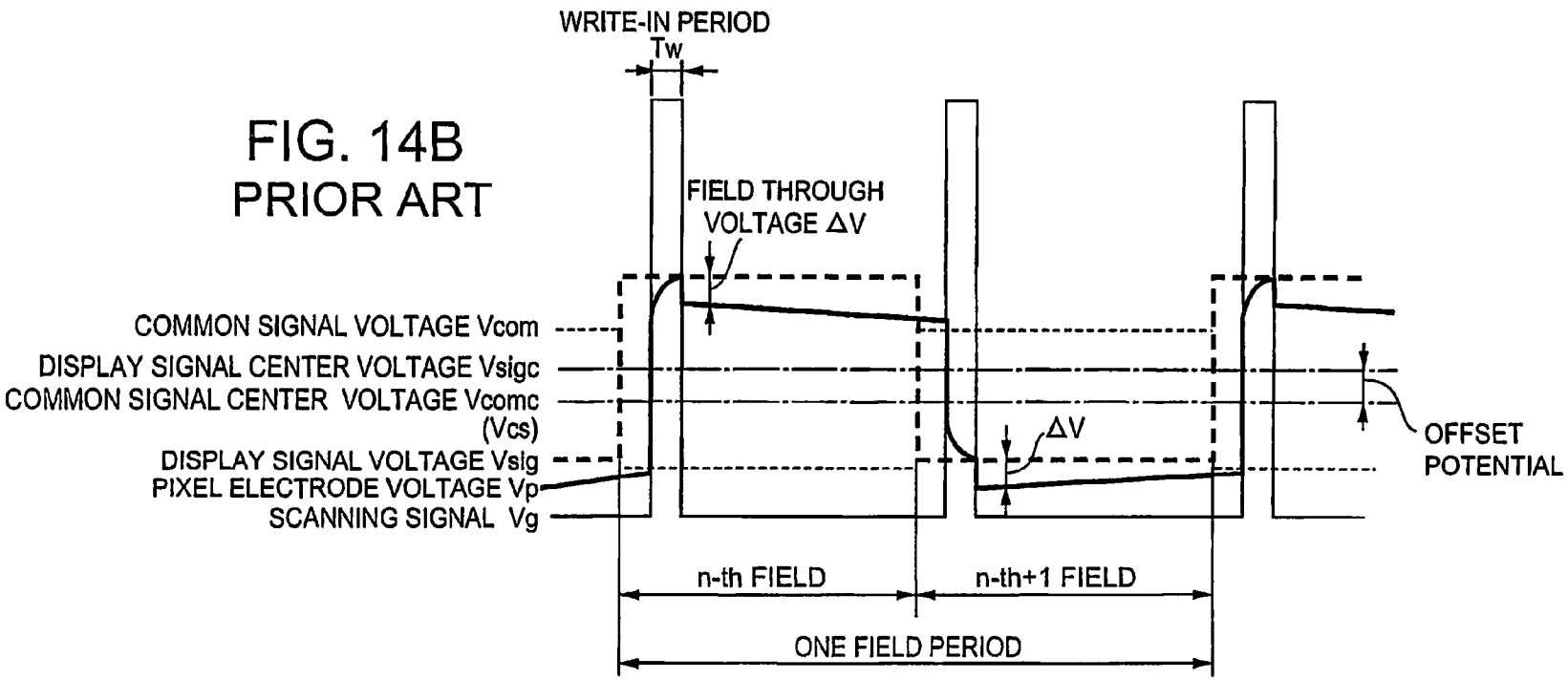
FIG. 14B PRIOR ART
FIG. 14B is drawing showing the drive voltage waveform in the case of writing display signal voltage to the display pixel clusters of a predetermined line of the liquid crystal display panel.

In the data driver which has such a configuration as shown in FIG. 7, if the contrast (i.e., the ratio of the reference voltages VRH and VRL; VRH/VRL) is changed, the center level Vsigc of the display signal outputted from the data driver will change. Accordingly, as mentioned above (Refer to FIG. 14B) pertaining to the level of the common signal voltage Vcom, if the contrast is changed when being set as the voltage shifted by the optimum predetermined offset potential from the center level Vsigc of the display signal voltage Vsig before changing the contrast, as the potential difference of the level of the common signal voltage Vcom and the center level Vsigc of the display signal voltage changes, there must a method to prevent having to reset the voltage of the common signal voltage Vcom so it can be reset as the voltage which shifted the level of the common signal voltage Vcom by the optimum offset potential to the center level Vsigc of the display signal voltage Vsig. Thereby, as adjustment control processing of the common signal voltage becomes more complicated, it has problems such as generation of flicker, sticking of the liquid crystal molecules and the like which may be experienced.

Consequently, in the data driver shown in the first embodiment mentioned above, in order to control the fluctuation effect (ΔΔV characteristic) of the field through voltage ΔV, the configuration is made to change the center level (display signal center voltage) Vsigc in reverse of the display signal voltage Vsig (gradation voltage) outputted from the data driver of the voltage amount according to the correction voltage (ΔΔV correction amount) to the luminosity gradations of the display data. The display signal voltage Vsig (gradation voltage) is set as a specific signal polarity by setting the highest gradation and lowest gradation voltage as the voltage value of the same voltage amount (correction voltage) changed in the opposite direction to the reference voltage VRH by the high potential side and the reference voltage VRL by the low potential side to each other. Even if it is the case where the contrast (VRH/VRL) is changed, the data driver prevents the change characteristic of the center level Vsigc of the display signal voltage Vsig (gradation voltage) for each luminosity gradation from changing. Specifically, the data driver maintains constant the change inclination of the center level Vsigc which has linearity. Thereby, even in the case where the contrast is changed, readjustment of the complicated common signal voltage Vcom level can be made unnecessary.

Therefore, in the data driver shown in this embodiment, the generation of flicker, sticking of the liquid crystal molecules and the like caused by the effect of the field through voltage ΔV changes according to the voltage level of the display signal voltage Vsig can be fully controlled and improvement in the display quality and the longevity life of the display panel can be attained.

<<The Second Embodiment of the Display Drive Device>>

Subsequently, the second embodiment of the data driver (display drive device) concerning this invention will be explained with reference to the drawings.

As the data driver applicable to the display device concerning this invention in the first embodiment mentioned above, although the case comprising the changeover switches SWA and SWB which suitably switches and controls these changeover switches SWA, SWB based on the polarity changeover signal POL; has a configuration which switches and sets the reference voltage VRH by the high potential side, the reference voltage VRL by the low potential side, and a connecting location with the division resistance Rsa; sets to one side of the signal polarity of the display signal voltage Vsig (gradation voltage); set the reference voltage which regulates the highest gradation and lowest gradation that increases and decreases by predetermined correction voltage respectively from the reference voltage VRH by the high potential side and the reference voltage VRL by the low potential side; and performs ΔΔV correction was explained, this invention is not limited to this.

Figure 8:
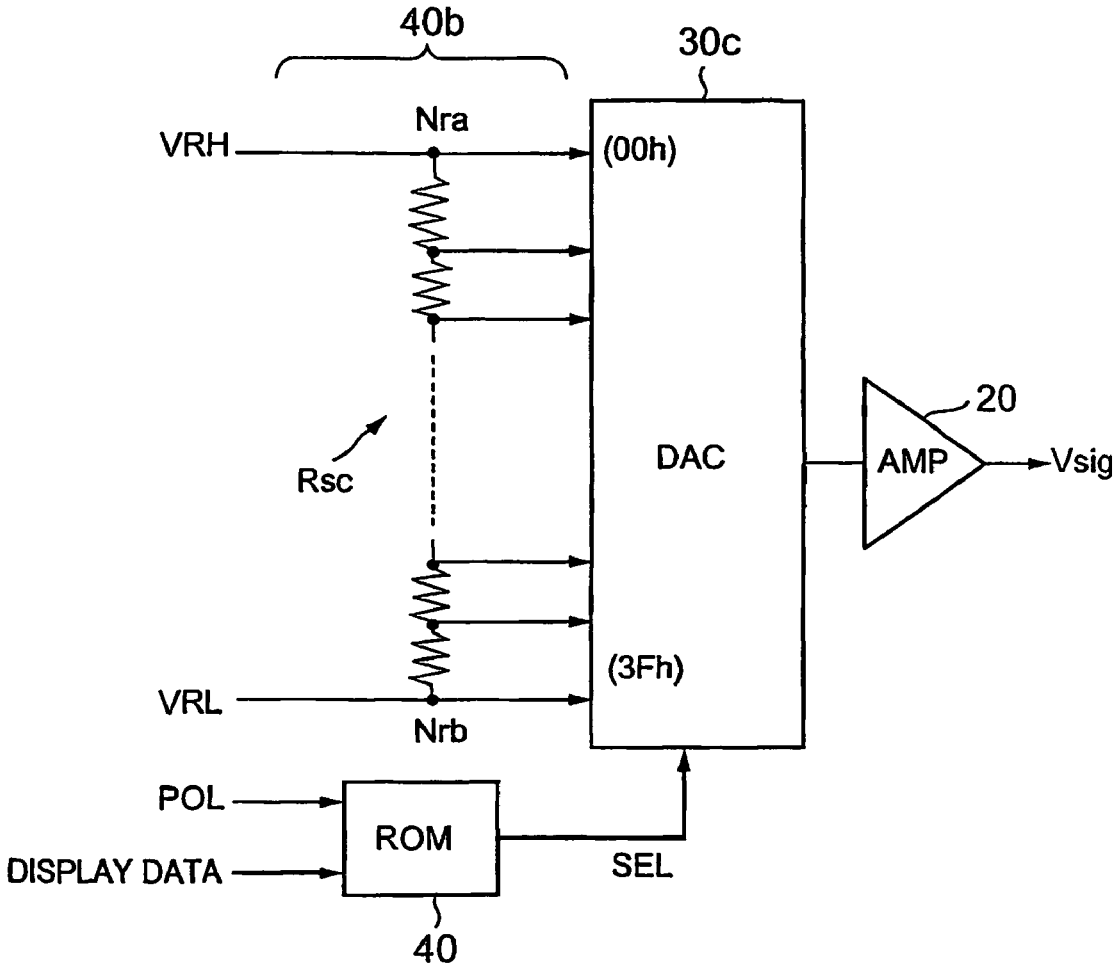
FIG. 8 is an outline block diagram showing the second embodiment of the section concerning the output of the display signal voltage of the data driver concerning this invention.

FIG. 8 is an outline block diagram showing the second embodiment of the section concerning the output of the display signal voltage of the data driver concerning this invention.

Here, concerning any configuration equivalent to the first embodiment mentioned above, the same or equivalent nomenclature is appended and the explanation is simplified or omitted from the description.

As shown in FIG. 8, the data driver in this embodiment has a configuration which comprises a gradation voltage setting circuit 40*b*, a data storage section (storage circuit) ROM 40, a D/A Converter (gradation conversion circuit) DAC 30*c* and an output amplifier AMP 20. Specifically, the gradation voltage setting circuit 40*b* comprises the division resistance (voltage divider circuit) Rsc consists of the reference voltage VRH by the high potential side which supplies the terminal end contact Nra on one end and the reference voltage VRL by the low potential side which supplies on the other end. The data storage section ROM 40 which produces and outputs a selection control signal SEL that selects a plurality of gradation voltages outputted from the division resistance Rsc in order to have the correlation equivalent to the input data (luminosity gradations) and the output level (display signal voltage) which are shown in the characteristic curve of FIG. 4 in the D/A Converter DAC 30*c* based on the display data and the polarity changeover signal POL. The D/A Converter DAC 30*c* which selects gradation voltages from a plurality of gradation voltages produced by performing voltage division of the potential difference between the reference voltages VRH and VRL from the division resistance Rsc are supplied based on the selection control signal SEL supplied from the data storage section ROM 40 and converted into analog voltage.

The output amplifier AMP 20 supplies each of the data lines DL by converting the analog voltage into the display signal voltage Vsig.

Here, the data storage section ROM 40, for example, can apply the Read-Only Memory (ROM) in combination with the selection control signal SEL which can realize the correlation in the characteristic curve of the gradation voltages to the luminosity gradations shown in FIG. 4 previously stored in table format as to the display data (luminosity gradations), the polarity changeover signal POL and the D/A Converter DAC 30*c*. Moreover, in order for the gradation voltages produced by the division resistance Rsc to realize each correlation in the complex characteristic curve of the luminosity gradation and gradation voltage as shown in FIG. 4 with sufficient precision, as compared with the case of the first embodiment mentioned above, for example, which is set so that the resolution of the division resistance Rsc can be made high, more gradation voltages are produced at a more detailed voltage interval and set so that the D/A converter DAC 30*c* can be supplied.

In the data driver which has such a configuration, by inputting the display data from the display signal producing circuit 150 and the polarity changeover signal POL from the system controller 140 into the data storage section ROM 40 which stores a response table containing the corresponding relationship between the display data, the polarity changeover signal POL and the selection control signal SEL previously set, a predetermined selection control signal SEL from the response table is extracted and outputted to the D/A Converter DAC 30*c*. The D/A Converter DAC 30*c* selects gradation voltages from which the correlation of the display data and the display signal voltage which are shown in the characteristic curve of FIG. 4 are acquired from a plurality of gradation voltages supplied from the division resistance Rsc based on the selection control signal SEL extracted as above-mentioned and supplies a display signal voltage Vsig to each of the data lines DL via the output amplifier AMP 20.

Therefore, in order to control the fluctuation effect of the field through voltage ΔV in the same manner as the first embodiment above, a configuration which is made to change the center level (display signal center voltage) Vsigc in reverse of the display signal voltage Vsig (gradation voltage) outputted from the data driver by the voltage amount according to the correction voltage (ΔΔV correction amount) to the luminosity gradations of the display data is used. When the display signal voltage Vsig (gradation voltage) is set as a specific signal polarity such as the characteristic curve of the gradation voltage to the luminosity gradations at the time of POL="H" shown in FIG. 4, since the highest gradation and lowest gradation can be set as the voltage value of the same voltage amount (correction voltage) changed in the opposite direction to the reference voltage VRH by the high potential side and the reference voltage VRL by the low potential side to each other, even if it is the case where the contrast is changed, the change characteristic of the center level Vsigc of the display signal voltage Vsig for each luminosity gradation is maintained constant and readjustment of the common signal voltage Vcom level can be made unnecessary.

<<The Third Embodiment of the Display Drive Device>>

Next, the third embodiment of the data driver (display drive device) concerning this invention will be explained with reference to the drawings.

Figure 9:
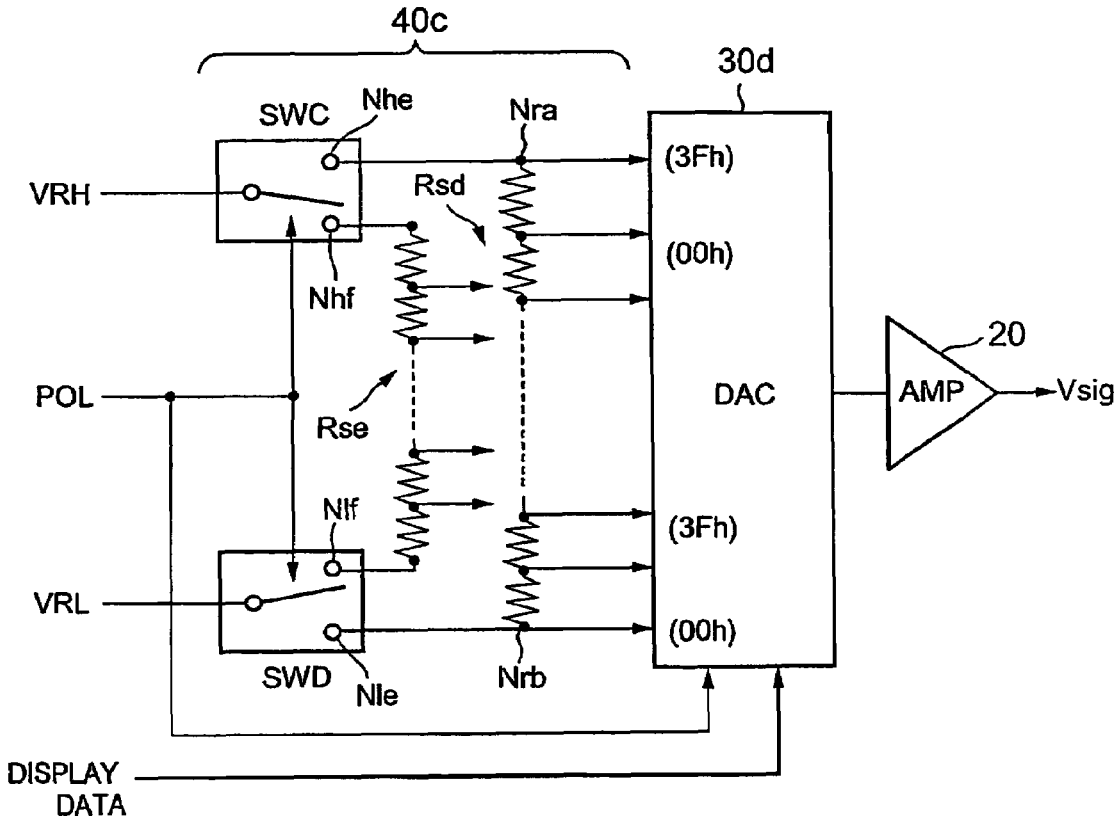
FIG. 9 is an outline block diagram showing the third embodiment of the section concerning the output of the display signal voltage of the data driver concerning this invention.

FIG. 9 is an outline block diagram showing the third embodiment of the section concerning the output of the display signal voltage of the data driver concerning this invention.

Figure 10A:
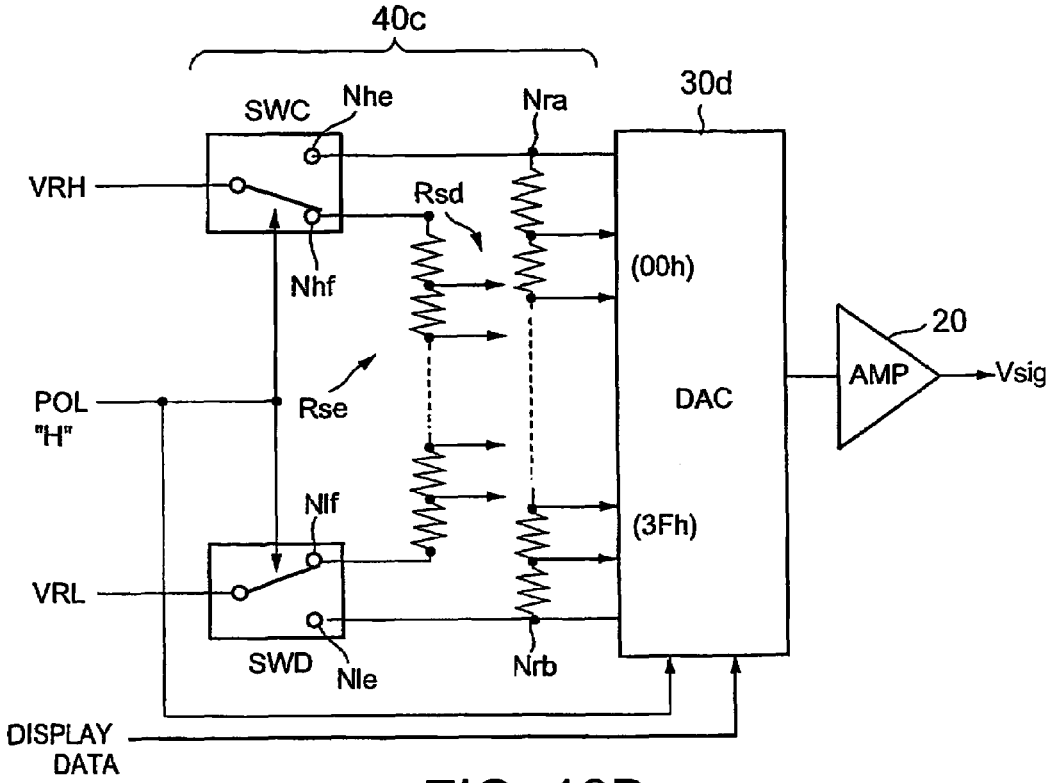
FIGS. 10A and 10B are conceptual diagrams showing an operating state of the data driver concerning the third embodiment.
Figure 10B:
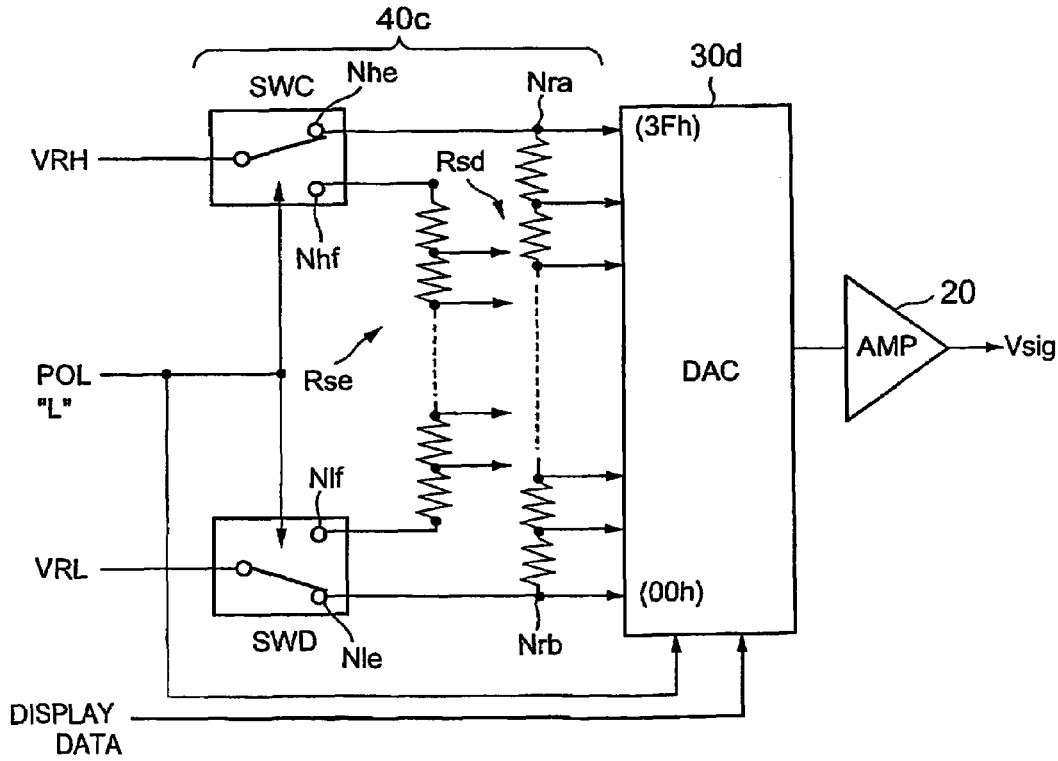

FIGS. 10A and 10B are conceptual diagrams showing an operating state of the data driver concerning the third embodiment.

Figure 11:
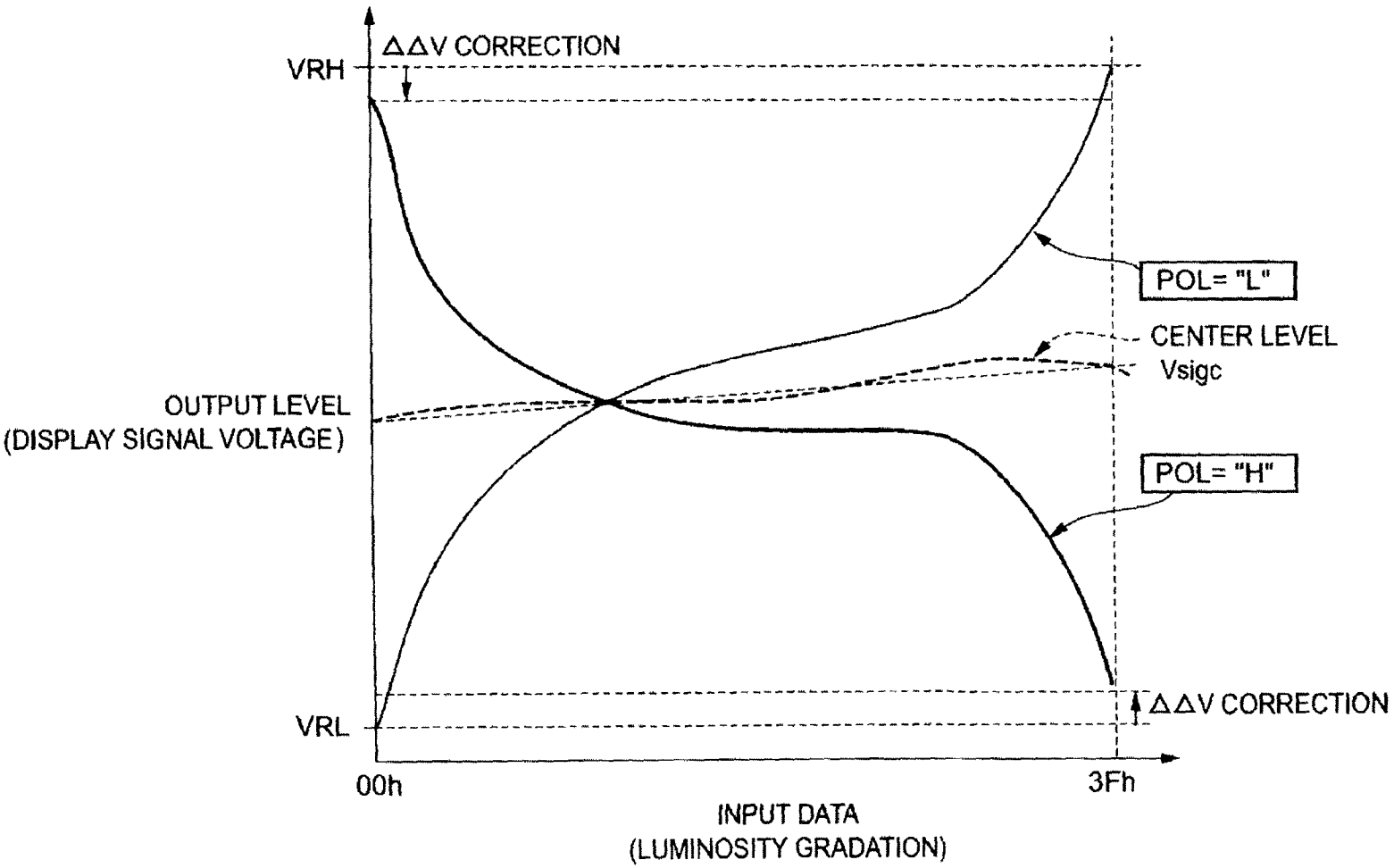
FIG. 11 is a characteristic drawing showing an example of the relationship of the output level to the input data of the data driver concerning the third embodiment.
Figure 12:
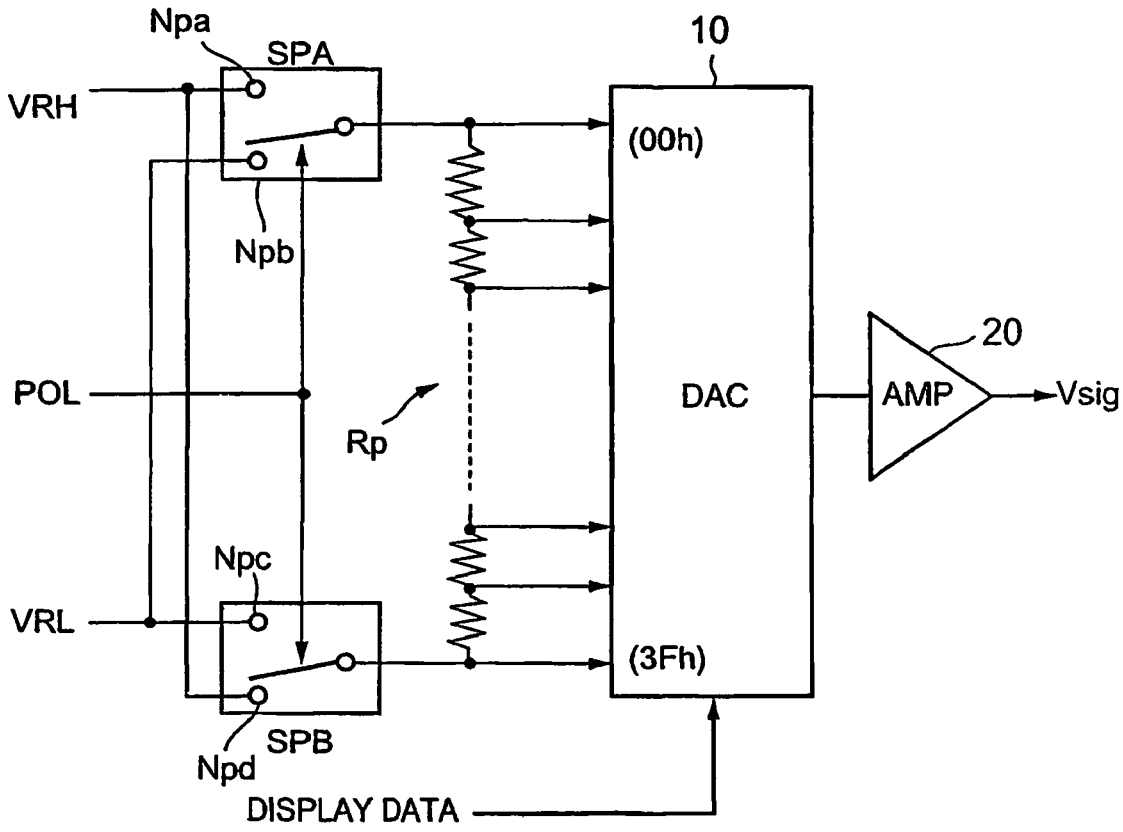
FIG. 12 PRIOR ART
FIG. 12 is an outline block diagram showing an example of the configuration of the section concerning the output of the display signal voltage of the data driver as applied to a liquid crystal display in a conventional technology.

FIG. 11 is a characteristic drawing showing an example of the relationship of the output level (display signal voltage) to the input data (luminosity gradations) of the data driver concerning the third embodiment.

Here, concerning any configuration equivalent to each embodiment mentioned above, the same or equivalent nomenclature is appended and the explanation is simplified or omitted from the description.

As shown in FIGS. 10A and 10B, the data driver related to this embodiment, for example, comprises a gradation voltage setting circuit 40*c*, a D/A Converter (gradation conversion circuit) DAC 30*d* and an output amplifier (display signal voltage output circuit) AMP 20. Specifically, the gradation voltage setting circuit 40*c* comprises a changeover switch (voltage divider circuit switching circuit) SWC, a changeover switch (voltage divider switching circuit) SWD, the division resistance Rsd (first voltage divider circuit) and the division resistance (second voltage divider circuit) Rse. The changeover switch SWC selectively switches and controls the reference voltage VRH by the high potential side of either contact Nhe or contact Nhf. The changeover switch SWD selectively switches and control the reference voltage VRL by the low potential side of either contact Nle or contact Nlf. The division resistance Rsd (first voltage divider circuit) reference voltage VRH by the high potential side is supplied on one end side via contact Nhe of the changeover switch SWC, and the reference voltage VRL by the low potential side is supplied on the other end side via contact Nle of the changeover switch SWD. The division resistance Rse (second voltage divider circuit) reference voltage VRH by the high potential side is supplied on one end side via contact Nhf of the changeover switch SWC, and the reference voltage VRL by the low potential side is supplied on the other end side via contact Nlf of the changeover switch SWD. The first gradation voltage group and second gradation voltage group produces by performing voltage division with the division resistance Rsd or the division resistance Rse selected by the changeover switches SWC and SWD. The D/A Converter DAC 30*d* selects the gradation voltage according to the luminosity gradations set by the display data and converted into analog voltage. The output amplifier AMP 20 supplies each of the data lines DL by converting the analog voltage into the display signal voltage Vsig.

Here, the changeover switches SWC and SWD are switched and controlled synchronously in combination by the contact Nhe and contact Nle side; and in combination by the contact Nhf and contact Nlf side based on the polarity changeover signal POL supplied from the system controller 140. Also, the division resistance Rsd and the division resistance Rse are constituted so as to have different voltage division characteristics to each other.

Furthermore, as the display data from the display signal producing circuit 150 is inputted into the D/A Converter DAC 30*d*, the polarity changeover signal POL is inputted, and from the first gradation voltage group or the second gradation voltage group supplied from the division resistance Rsd or the division resistance Rse, a gradation voltage group is selected according to the polarity which switches and controls that side.

In the gradation voltage setting circuit 40*c* of the data driver which has such a configuration as shown in FIG. 10A, when the polarity changeover signal POL is set as a high level ("H"), as the changeover switch SWC switches and controls the contact Nhf side the changeover switch SWD switches and controls the contact Nlf side. Thereby, the division resistance Rse is selected and the second gradation group produces by performing voltage division from the division resistance Rse of the potential difference (VRH−VRL) between the contact Nhf and contact Nlf and supplied to the D/A Converter DAC 30*d*.

Therefore, when the digitized data 00h (corresponds to a black display) which is the lowest gradation is inputted as the display data such as the characteristic curve of POL="H" shown in FIG. 11, the voltage (VRH−ΔΔV) which decreased by the correction voltage (ΔΔV correction amount) is regulated from the division resistance Rse to the reference voltage VRH by the high potential side and is outputted as the lowest gradation voltage of the display signal voltage Vsig (gradation voltage). Also, when the digitized data 3Fh (corresponds to a white display) which is the highest gradation is inputted, the voltage (VRH+ΔΔV) which increased by the correction voltage (ΔΔV correction amount) is regulated from the division resistance Rse to the reference voltage VRL by the low potential side and is outputted as the highest gradation voltage of the display signal voltage Vsig (gradation voltage).

Conversely, when the polarity changeover signal POL is set as a low level ("L") as shown in FIG. 10B, as the changeover switch SWC switches and controls the contact Nhe side the changeover switch SWD switches and controls the contact Nle side. Thereby, the division resistance Rsd is selected and the first gradation group produces by performing voltage division of the potential difference between terminal end contacts Nra and Nrb from the division resistance Rsd and supplied to the D/A Converter DAC 30*d*.

Therefore, when the digitized data 00h which is the lowest gradation is inputted as the display data such as the characteristic curve of POL="L" shown in FIG. 11, the reference voltage VRL by the low potential side is outputted as the lowest gradation voltage of the display signal voltage Vsig (gradation voltage). Also, when the digitized data 3Fh which is the highest gradation is inputted, the reference voltage VRH by the high potential side is outputted as the highest gradation voltage of the display signal voltage Vsig (gradation voltage).

As the level of gradation voltage is reversed according to reversal of the polarity changeover signal (POL="H" and POL="L") and reverse control of the signal polarity of the display signal voltage Vsig (gradation voltage) is performed. As shown in FIG. 11, in the reverse gradation voltages corresponding to reversal of the polarity changeover signal POL, the center level (display signal center voltage) Vsigc is regulated with an average value of the display signal voltage Vsig (gradation voltage) of each gradation voltage to the input data (luminosity gradations) corresponding to the fluctuation characteristic of the field through voltage ΔV which is set so that the data driver has a nonlinear change characteristic.

Figure 15A:
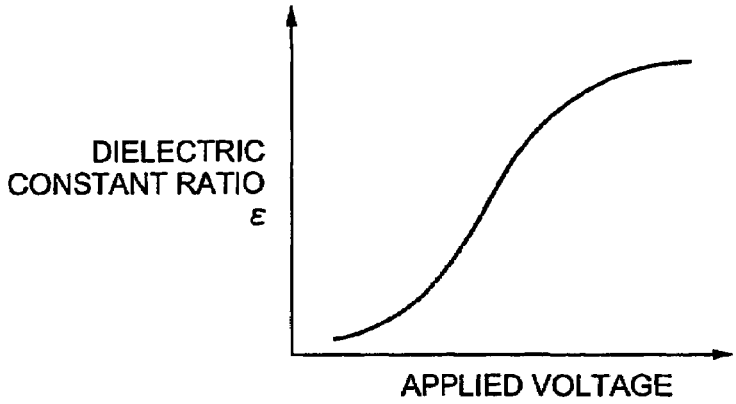
FIG. 15A PRIOR ART
FIGS. 15A, 15B and 15C are characteristic drawings showing the relationship of the applied voltage to the liquid crystal with the liquid crystal dielectric constant, the liquid crystal capacity and the field through voltage, respectively.
Figure 15B:
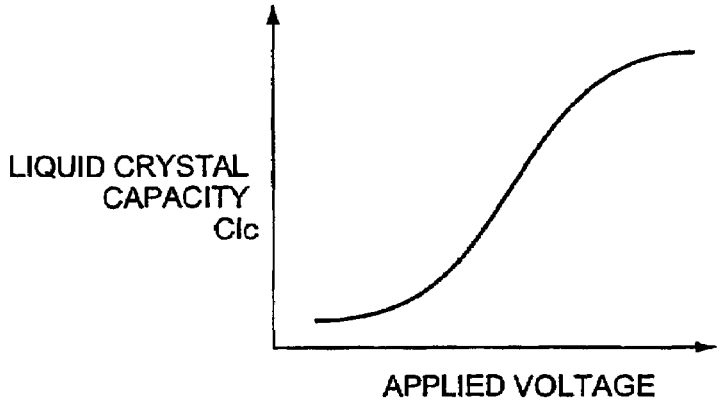
FIG. 15B PRIOR ART
Figure 15C:
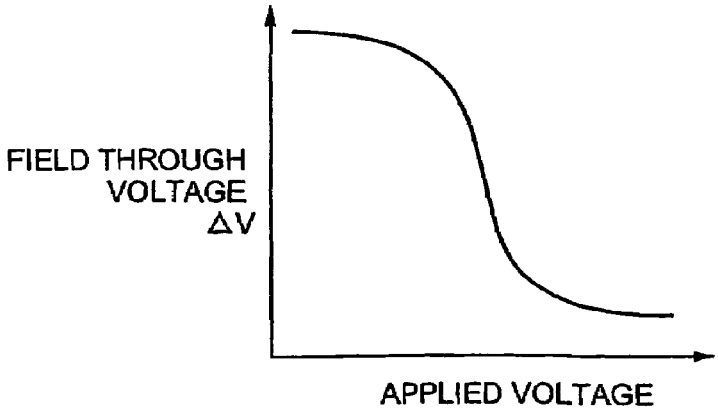
FIG. 15C PRIOR ART

Specifically, in the data driver shown in the first embodiment mentioned above, as shown in FIG. 4, when the display data becomes the lowest gradation (00h) and the highest gradation (3Fh), ΔΔV correction is performed respectively, and the center level Vsigc in reversal of the display signal voltage Vsig (gradation voltage) changes linearly according to the gradation of the display data. However, in actuality the field through voltage ΔV in particular does not show change with linearity in the middle gradations of the liquid crystal applied voltage; it has nonlinearity as shown in FIG. 15C.

Consequently, in this embodiment by setting the division resistance Rsd and the division resistance Rse so that each has different voltage division characteristics to each other and one or the other is selected according to polarity reversal, the data driver is configured so that the change to the luminosity gradations of the center level Vsigc in reversal of the display signal voltage Vsig (gradation voltage) becomes a nonlinear change corresponding to the change of the field through voltage ΔV, and even when the display data constitutes middle gradations this configuration performs ΔΔV correction favorably.

Appropriately, in the data driver shown in this embodiment, in order to control the fluctuation effect (ΔΔV characteristic) of the field through voltage ΔV, the configuration is made to change the center level (display signal center voltage) Vsigc in reverse of the display signal voltage Vsig (gradation voltage) outputted from the data driver corresponding the display data to the luminosity gradations of the display data. When the display signal voltage Vsig is set as a specific signal polarity, in addition to the gradation voltage by the highest gradation side and the gradation voltage by the lowest gradation side, even in the gradation voltages in the middle gradations ΔΔV correction can be performed favorably. Accordingly, even if it is the case where the contrast (VRH/VRL) is changed, the data driver maintains constant the change inclination of the center level Vsigc which has nonlinearity. That is to say, the change characteristic of the center level Vsigc of the display signal voltage Vsig for each luminosity gradation does not change, and even in the case where the contrast is changed, readjustment of the common signal voltage Vcom can be made unnecessary.

Therefore, in the data driver shown in this embodiment, the generation of flicker, sticking of the liquid crystal molecules and the like caused by the effect of the field through voltage ΔV changes according to the voltage level of the display signal voltage Vsig can be further controlled and improvement in the display quality and the longevity life of the display panel can be attained.

In addition, in this embodiment comprising the changeover switches SWC and SWD which suitably switches and controls these changeover switches SWC, SWD based on the polarity changeover signal POL, although the case where the division resistance applies the ΔΔV correction in the reference voltage VRH by the high potential side and the reference voltage VRL by the low potential side together with the middle gradations switches and control for each polarity was explained, this invention is not limited to this.

For example, as illustrated in the second embodiment mentioned above (Refer to FIG. 8), the correlation in the characteristic curve of the gradation voltages to the luminosity gradations as shown in FIG. 11 is realizable in the data storage section ROM 40 which stores the response table containing the previously set corresponding relationship between the display data, the polarity changeover signal POL and the selection control signal SEL of the gradation voltages; extracts the predetermined selection control signal based on the display data and the polarity changeover signal POL; subsequently the D/A Converter DAC 30*c* selects the gradation voltages from which the correlation of the display data and the display signal voltage which are shown in the characteristic curve of FIG. 11 are acquired from a plurality of gradation voltages supplied from the division resistance Rsc based on the selection control signal SEL extracted as above-mentioned, and each of the data lines DL may be supplied via the output amplifier AMP 20.

While the present invention has been described with reference to the preferred embodiments, it is intended that the invention be not limited by any of the details of the description thereof.

As this invention can be embodied in several forms without departing from the spirit of the essential characteristics thereof, the present embodiments are therefore illustrative and not restrictive, since the scope of the invention is defined by the appended claims rather than by the description preceding them, and all changes that fall within meets and bounds of the claims, or equivalence of such meets and bounds thereof are intended to be embraced by the claims.

The invention claimed is:

1. A display drive device which drives a display panel comprising a plurality of display pixels based on display data composed of digital signals, said display drive device comprising:

a gradation voltage setting circuit which performs voltage division of a highest reference voltage and a lowest reference voltage that are supplied, and produces a plurality of gradation voltages corresponding to each luminosity gradation of the display data;

a gradation conversion circuit which produces a display signal voltage of a different voltage level for each luminosity gradation of the display data based on the plurality of gradation voltages produced by the gradation voltage setting circuit, wherein two different voltage levels of the display signal voltage are produced for the luminosity gradations in a predetermined period; and a display signal voltage output circuit which applies the display signal voltage produced by the gradation conversion circuit to the display pixels;

wherein a center voltage of the two voltage levels of the display signal voltage at a highest luminosity gradation of the luminosity gradations of the display data is set to a potential higher than the center voltage at a lowest luminosity gradation of the luminosity gradations by only an amount corresponding to a correction voltage that is set based on characteristics of the display pixels;

wherein a difference of voltage level for the center voltage between a first highest gradation voltage and a second highest gradation voltage which correspond to the two voltage levels of the display signal voltages at the highest luminosity gradation, and a difference of voltage level for the center voltage between a first lowest gradation voltage and a second lowest gradation voltage which correspond to the two voltage levels of the display signal voltages at the lowest luminosity gradation are set to an equivalent value;

wherein a first voltage range comprised of the difference between the first highest gradation voltage and the first lowest gradation voltage, and a second voltage range comprised of the difference between the second highest gradation voltage and the second lowest gradation voltage are changed by only an amount corresponding to a change of the highest reference voltage or the lowest reference voltage, when at least one of the highest reference voltage or the lowest reference voltage is changed; and wherein a change characteristic value of the center voltage is maintained constant for each luminosity gradation of the display data.

2. The display drive device according to claim 1, wherein the gradation voltage setting circuit comprises a voltage divider circuit which applies the highest reference voltage and the lowest reference voltage to both ends, performs voltage division of the potential difference between the highest reference voltage and the lowest reference voltage in a plurality of stages, and produces a plurality of gradation voltages.

3. The display drive device according to claim 2, wherein the voltage divider circuit includes a plurality of resistance elements connected in series with the highest reference voltage and the lowest reference voltage which is applied to both ends of the plurality of resistance elements.

4. The display drive device according to claim 2, wherein the gradation conversion circuit comprises a gradation voltage selection circuit which selects the gradation voltage corresponding to each luminosity gradation of the display data from the plurality of gradation voltages produced by the voltage divider circuit and outputs the selected gradation voltages as the display signal voltage.

5. The display drive device according to claim 1, wherein a plurality of display pixels of the display panel are liquid crystal display pixels with liquid crystal molecules filled between a common counter electrode and a pixel electrode where the display signal voltage is applied; and wherein the correction voltage is a voltage corresponding to the voltage difference of the field through voltage produced when the display signal voltage corresponding to the first highest gradation voltage and the second lowest gradation voltage is applied to the display pixels.

6. The display drive device according to claim 1, wherein the gradation voltage setting circuit comprises a gradation voltage switching circuit which alternately switches in the predetermined period the first highest gradation voltage and the first lowest gradation voltage with the second highest gradation voltage and the second lowest gradation voltage for the highest reference voltage and the lowest reference voltage which are applied to both ends of the voltage divider circuit.

7. The display drive device according to claim 6, wherein the gradation voltage switching circuit comprises a switching element which alternately selects one of the highest reference voltage or the lowest reference voltage in the predetermined period.

8. The display drive device according to claim 1, wherein the voltage divider circuit comprises:

a first voltage divider circuit where the first highest reference voltage and lowest reference voltage is applied at both ends; and a second voltage divider circuit where the second highest reference voltage and lowest reference voltage is applied at both ends; and wherein the gradation voltage setting circuit comprises a voltage divider circuit switching circuit which selects the first voltage divider circuit or the second voltage divider circuit in the predetermined period.

9. The display drive device according to claim 8, wherein the first voltage divider circuit and the second voltage divider circuit have different voltage division characteristics.

10. The display drive device according to claim 1, wherein the change characteristic of the center voltage for each luminosity gradation has a linear change inclination according to each luminosity gradation.

11. The display drive device according to claim 10, wherein a plurality of display pixels of the display panel are liquid crystal display pixels with liquid crystal molecules filled between a common counter electrode and a pixel electrode where the display signal voltage is applied; and wherein the change characteristic of the center voltage for each luminosity gradation has a characteristic corresponding to a characteristic in which straight line approximation is performed for the change inclination of the field through voltage produced when the display signal voltage of each luminosity gradation is applied to the display pixels.

12. The display drive device according to claim 1, wherein the gradation voltage setting circuit sets the change characteristic of the center voltage for each luminosity gradation to have a nonlinear change inclination according to each luminosity gradation.

13. The display drive device according to claim 12, wherein a plurality of display pixels of the display panel are liquid crystal display pixels with liquid crystal molecules filled between a common counter electrode and a pixel electrode where the display signal voltage is applied; and wherein the change characteristic of the center voltage for each luminosity gradation has a characteristic corresponding to the change inclination of the field through voltage produced when the display signal voltage of each luminosity gradation to the display pixels is applied.

14. A display device which performs image display based on the display data composed of digital signals, said display device comprising:

a display panel in which two-dimensional array of a plurality of display pixels is performed; and a data driver including:

a scanning driver which sequentially scans a display pixel cluster of each line of the display panel and sets the scanned display pixel cluster in a selective state;

a gradation voltage setting circuit which performs voltage division of a provided highest reference voltage and a provided lowest reference voltage, and produces a plurality of gradation voltages corresponding to each luminosity gradation of the display data;

a gradation conversion circuit which produces a display signal voltage of a different voltage level for each luminosity gradation of the display data based on the plurality of gradation voltages produced by the gradation voltage setting circuit, wherein two different voltage levels of the display signal voltage are produced for the luminosity gradations in a predetermined period; and a display signal voltage output circuit which applies the display signal voltage to the display pixels;

wherein in the data driver, a center voltage of the two voltage levels of the display signal voltage at a highest luminosity gradation of the luminosity gradations of the display data is set to a potential higher than the center voltage in a lowest luminosity gradation of the luminosity gradations by only an amount corresponding to a correction voltage that is set based on characteristics of the display pixels;

wherein a difference of voltage level for the center voltage between a first highest gradation voltage and a second highest gradation voltage which correspond to the two voltage levels of the display signal voltages at the highest luminosity gradation, and a difference of voltage level for the center voltage between a first lowest gradation voltage and a second lowest gradation voltage which correspond to the two voltage levels of the display signal voltages at the lowest luminosity gradation are set to an equivalent value;

wherein a first voltage range comprised of the difference between the first highest gradation voltage and the first lowest gradation voltage, and a second voltage range comprised of the difference between the second highest gradation voltage and the second lowest gradation voltage are charged by only an amount corresponding to a change of the highest reference voltage or the lowest reference voltage, when at least one of the highest reference voltage or the lowest reference voltage is changed; and wherein a change characteristic value of the center voltage is maintained constant for each luminosity gradation of the display data.

15. The display device according to claim 14, wherein the data driver comprises a voltage divider circuit which applies the highest reference voltage and the lowest reference voltage to both ends, performs voltage division of the potential difference between the highest reference voltage and the lowest reference voltage in a plurality of stages, and produces a plurality of gradation voltages.

16. The display device according to claim 15, wherein the voltage divider circuit includes a plurality of resistance elements connected in series with the highest reference voltage and the lowest reference voltage which is applied to both ends of the plurality of resistance elements.

17. The display device according to claim 15, wherein the gradation conversion circuit in the data driver comprises a gradation voltage selection circuit which selects the gradation voltage corresponding to each luminosity gradation of the display data from the plurality of gradation voltages produced by the voltage divider circuit and outputs the selected gradation voltages as the display signal voltage.

18. The display device according to claim 15, wherein the voltage divider circuit comprises:

a first voltage divider circuit where the first highest reference voltage and lowest reference voltage is applied at both ends; and a second voltage divider circuit where the second highest reference voltage and lowest reference voltage is applied at both ends; and wherein the data driver comprises a voltage divider circuit switching circuit which selects the first voltage divider circuit or the second voltage divider circuit in the predetermined period.

19. The display device according to claim 18, wherein the first voltage divider circuit and the second voltage divider circuit have different voltage division characteristics.

20. The display device according to claim 15, wherein the data driver sets the change characteristic of the center voltage for each luminosity gradation to have a nonlinear change inclination according to each luminosity gradation.

21. The display device according to claim 20, wherein a plurality of display pixels of the display panel are liquid crystal display pixels with liquid crystal molecules filled between a common counter electrode and a pixel electrode where the display signal voltage is applied; and wherein the change characteristic of the center voltage for each luminosity gradation has a characteristic corresponding to the change inclination of the field through voltage produced when the display signal voltage of each luminosity gradation to the display pixels is applied.

22. The display device according to claim 14, wherein a plurality of display pixels of the display panel are liquid crystal display pixels with liquid crystal molecules filled between a common counter electrode and a pixel electrode where the display signal voltage is applied; and wherein the correction voltage is a voltage corresponding to the voltage difference of the field through voltage produced when the display signal voltage corresponding to the first highest gradation voltage and the second lowest gradation voltage is applied to the display pixels.

23. The display device according to claim 14, wherein the data driver comprises a gradation voltage switching circuit which alternately switches in the predetermined period the first highest gradation voltage and the first lowest gradation voltage with the second highest gradation voltage and the second lowest gradation voltage for the highest reference voltage and the lowest reference voltage which are applied to both ends of the voltage divider circuit.

24. The display device according to claim 23, wherein the gradation voltage switching circuit comprises a switching element which alternately selects one of the highest reference voltage or the lowest reference voltage in the predetermined period.

25. The display device according to claim 14, wherein the data driver further comprises:

a storage circuit which stores information showing a relationship of the gradation voltages for each luminosity gradation of the display data;

a circuit that sets the first highest gradation voltage and lowest gradation voltage which regulate the voltage range of the display signal in one side of the reverse gradation voltages based on the relationship of the gradation voltages for each luminosity gradation stored in the storage circuit; and a circuit that sets the second highest gradation voltage and lowest gradation voltage which regulate the voltage range of the display signal in the other side of the reverse gradation voltages.

26. The display device according to claim 25, wherein the gradation conversion circuit comprises a gradation voltage selection circuit which selects the gradation voltages corresponding to the luminosity gradations of the display data and outputs the selected gradation voltage as the display signal voltage based on the relationship of the gradation voltages for each luminosity gradation stored in the storage circuit from a plurality of gradation voltages produced by the voltage divider circuit.

27. The display device according to claim 14, wherein the change characteristic of the center voltage for each luminosity gradation in the data driver has a linear change inclination according to each luminosity gradation.

28. The display device according to claim 27, wherein a plurality of display pixels of the display panel are liquid crystal display pixels with liquid crystal molecules filled between a common counter electrode and a pixel electrode where the display signal voltage is applied; and wherein the change characteristic of the center voltage for each luminosity gradation has a characteristic corresponding to a characteristic in which straight line approximation is performed for the change inclination of the field through voltage produced when the display signal voltage of each luminosity gradation is applied to the display pixels.

29. A drive controlling method for a display drive device which drives a display panel comprising a plurality of display pixels based on display data composed of digital signals, the method comprising:

performing voltage division of a provided highest reference voltage and a provided lowest reference voltage, and producing a plurality of a gradation voltages corresponding to each luminosity gradation of the display data;

producing a display signal voltage of a different voltage level for each luminosity gradation of the display data based on the produced plurality of gradation voltages, wherein two different voltage levels of the display signal voltage are produced for the luminosity gradations in a predetermined period;

setting a center voltage of the two voltage levels of the display signal voltage at a highest luminosity gradation of the luminosity gradations by only an amount corresponding to a correction voltage that is set based on characteristics of the display pixels;

setting a difference of voltage level for the center voltage between a first highest gradation voltage and a second highest gradation voltage which correspond to the two voltage levels of the display signal voltages at the highest luminosity gradation, and a difference of voltage level for the center voltage between a first lowest gradation voltage and a second lowest gradation voltage which correspond to the two voltage levels of the display signal voltages at the lowest luminosity gradation to an equivalent value;

changing a first voltage range comprised of the difference between the first highest gradation voltage and the first lowest gradation voltage, and a second voltage range comprised of the difference between the second highest gradation voltage and the second lowest gradation voltage by only an amount corresponding to a change of the highest reference voltage or the lowest reference voltage, when at least one of the highest reference voltage or the lowest reference voltage is changed;

maintaining a change characteristic value of the center voltage constant for each luminosity gradation of the display data.

30. The drive controlling method for a display drive device according to claim 29, wherein a plurality of display pixels of the display panel are liquid crystal display pixels with liquid crystal molecules filled between a common counter electrode and a pixel electrode where the display signal voltage is applied; and wherein the correction voltage is a voltage corresponding to the voltage difference of the field through voltage produced when the display signal voltage and the second lowest gradation voltage is applied to the display pixels.

31. The drive controlling method for a display drive device according to claim 29, wherein the change characteristic of the center voltage for each luminosity gradation has a linear change inclination according to each luminosity gradation.

32. The drive controlling method for a display drive device according to claim 29, wherein the change characteristic of the center voltage for each luminosity gradation has a nonlinear change inclination according to each luminosity gradation.

33. The drive controlling method for a display drive device according to claim 32, wherein a plurality of display pixels of the display panel are liquid crystal display pixels with liquid crystal molecules filled between a common counter electrode and a pixel electrode where the display signal voltage is applied; and wherein the change characteristic of the center voltage for each luminosity gradation has a characteristic corresponding to the change inclination of the field through voltage produced when the display signal voltage of each luminosity gradation to the display pixels is applied.

* * * * *

UNITED STATES PATENT AND TRADEMARK OFFICE

CERTIFICATE OF CORRECTION

PATENT NO. : 7,623,125 B2
APPLICATION NO. : 11/128138
DATED : November 24, 2009
INVENTOR(S) : Takahiro Harada It is certified that error appears in the above-identified patent and that said Letters Patent is hereby corrected as shown below:

On the Title page:

Below Item (22) Filed;

Insert Item --(30) Foreign Application Priority Data

Dec 26, 2002.....2002-376241--.

Under Item (56) References Cited, U.S. PATENT DOCUMENTS;

Change "Shiba et al" to --Ohi et al--.

Change "Kurokawa et al" to --Kudo et al--.

In the Claims:

(1) Column 21, line 63, (Claim 14, line 48);

Change "charged" to --changed--.

(2) Column 24, line 6, (Claim 29, line 18);

After "luminosity gradations" insert --of the display data to a potential higher than the center voltage in a lowest luminosity gradation of the luminosity gradations--.

(3) Column 24, line 39, (Claim 30, line 9);

After "signal voltage" insert --corresponding to the first highest gradation voltage--.

Signed and Sealed this

First Day of June, 2010

David J. Kappos

David J. Kappos
*Director of the United States Patent and Trademark Office*